US007086158B1

(12) United States Patent
Halpern et al.

(10) Patent No.: US 7,086,158 B1
(45) Date of Patent: Aug. 8, 2006

(54) SLIDING KNIFE WITH DISENGAGING BLADE ACTUATION MECHANISM

(76) Inventors: Les Halpern, 14 Maxwell Rd., Monson, MA (US) 01057; Peter D. Orszulak, 62 Ruggles St., Three Rivers, MA (US) 01080; John Kubasek, 74 Northhampton St., Easthampton, MA (US) 01027

( * ) Notice: Subject to any disclaimer, the term of this patent is extended or adjusted under 35 U.S.C. 154(b) by 56 days.

(21) Appl. No.: 10/131,267

(22) Filed: Apr. 22, 2002

Related U.S. Application Data

(60) Provisional application No. 60/286,304, filed on Apr. 25, 2001.

(51) Int. Cl.
*B26B 29/02* (2006.01)

(52) U.S. Cl. ..... 30/162; 30/335

(58) Field of Classification Search ..... 30/162, 30/163, 335, 336, 334, 151, 158, 159, 160, 30/161, 164; 224/232, 233
See application file for complete search history.

(56) References Cited

U.S. PATENT DOCUMENTS

| | | | | | |
|---|---|---|---|---|---|
| 57,902 | A | | 9/1866 | Hibbard | |
| 825,976 | A | * | 7/1906 | Neiglick | 30/162 |
| 845,792 | A | | 3/1907 | Jenkins | |
| 1,057,525 | A | | 4/1913 | Bruecker | |
| 1,068,209 | A | | 7/1913 | Bird | |
| 1,417,872 | A | * | 5/1922 | Wall | 30/162 |
| 1,496,188 | A | | 6/1924 | Wall | |
| 1,738,496 | A | | 12/1929 | Laux | |
| 2,284,168 | A | | 5/1942 | Rickenbacher | |
| 2,455,765 | A | | 12/1948 | Harvey | |
| 2,569,080 | A | | 9/1951 | Trimble et al. | |
| 3,263,432 | A | | 8/1966 | Maskell | |
| 4,211,003 | A | | 7/1980 | Collins | |
| 4,389,775 | A | | 6/1983 | Collins | |
| 4,426,779 | A | * | 1/1984 | Morgan | 30/158 |
| 4,466,561 | A | | 8/1984 | Slaughter | |
| 4,481,712 | A | * | 11/1984 | Phelps | 30/151 |
| 4,494,309 | A | | 1/1985 | Gray | |
| 4,494,310 | A | | 1/1985 | Slaughter | |
| 4,525,928 | A | | 7/1985 | Foster | |
| 4,529,111 | A | | 7/1985 | Hayakawa | |
| 4,541,556 | A | | 9/1985 | Collins et al. | |
| 4,561,577 | A | | 12/1985 | Moore | |
| 4,600,133 | A | | 7/1986 | Maihos | |

(Continued)

FOREIGN PATENT DOCUMENTS

| | | |
|---|---|---|
| DK | 1645 | 6/1898 |

(Continued)

*Primary Examiner*—Stephen Choi
(74) *Attorney, Agent, or Firm*—Seed IP Law Group PLLC

(57) ABSTRACT

A sliding knife with disengaging blade actuation mechanism comprises: a hollow handle; a blade having a detent near its base end and slidable within the handle between a first, fully retracted position and a second, deployed position; and a disengaging blade actuation mechanism, called a "tongue," which fits over the blade and within the handle, and has a ball dimensioned to fit within the blade's detent. In a retracted position, the blade and tongue lie within the handle. To extend the blade, the tongue is pulled away from the handle, pulling the blade along with it. Then, once the blade is fully extended, the tongue disengages from the blade. Thus, the tongue can be attached to clothing, and the knife can be actuated by simply pulling down on the handle with one hand. The knife also has locking mechanisms for securing the blade in its deployed and retracted positions.

34 Claims, 18 Drawing Sheets

U.S. PATENT DOCUMENTS

| | | | | |
|---|---|---|---|---|
| 4,805,819 | A | 2/1989 | Collins | |
| 4,848,000 | A | 7/1989 | O'Dell | |
| 4,909,424 | A | 3/1990 | Reynolds | |
| 5,123,167 | A | 6/1992 | Kelley | |
| 5,217,150 | A * | 6/1993 | Chen | 30/162 |
| 5,217,151 | A | 6/1993 | Parsons | |
| 5,349,753 | A | 9/1994 | Gaffney | |
| 5,361,497 | A | 11/1994 | Crawford | |
| 5,450,670 | A | 9/1995 | Sakai | |
| 5,511,311 | A | 4/1996 | Collins | |
| 5,822,867 | A | 10/1998 | Sakai | |
| 5,878,500 | A | 3/1999 | Emerson | |
| 6,442,843 | B1 | 9/2002 | Jue et al. | |
| 2002/0095792 | A1 | 7/2002 | Jue et al. | 30/151 |
| 2003/0089750 | A1 | 5/2003 | Martinez | |

FOREIGN PATENT DOCUMENTS

| | | |
|---|---|---|
| EP | 0 230 000 | 12/1986 |
| EP | 0 396 938 A1 | 11/1990 |

* cited by examiner

SLIDING KNIFE WITH DISENGAGING BLADE ACTUATION MECHANISM

This application claims the benefit of U.S. Provisional Application Ser. No. 60/286,304, filed Apr. 25, 2001.

FIELD OF THE INVENTION

The present invention relates to knives, and, more particularly, to sliding knives.

BACKGROUND

Knives are one of humanity's most universal tools, and, as such, are used for numerous purposes: cutting foods or other inert objects, combat and self-defense, surgery, hunting, etc. Many knives, like the common chefs knife, have a fixed, non-moving blade, while most others, like the common folding knife and switchblade, have a moving (e.g., sliding or pivoting) blade. In the former case, the blade is always exposed with respect to the handle and must be housed in a sheath for safety or blade protection. In the latter case, the blade can be pivoted or retracted to lie housed within the confines of the handle.

Although fixed-blade knives are relatively easily deployed (e.g., by pulling the knife out of a sheath), their fixed blades render them relatively bulky, and, unless a locking sheath or the like is provided, relatively unsafe. Most folding knives are more compact and somewhat safer, since their blades can be withdrawn into their handles. However, with folding knives, it is typically necessary for a user to use two hands to deploy the knife, e.g., one to grasp the handle and one to pull open the blade. Further, even with "one handed" knives like the thumb-stud folding knife, it is still necessary to remove the knife from whatever it is being carried in, and to properly grip the handle, prior to use. In situations where quick blade deployment is critical, such as combat, skydiving, scuba diving, rock climbing, and self-defense, any such delay can be critical.

Attempting to solve these problems, various "quick-deployment" folding knives have been provided over the years. For example, U.S. Pat. No. 5,349,753 to Gaffney ("Gaffney") discloses a "one-handed" knife comprising a knife portion and a separable tether. Pulling down on the knife portion causes the blade to swing open, via a sliding bar and cam mechanism, while pulling down further on the knife portion causes the separable tether to disengage, releasing the knife portion from the separable tether for use. For a sliding knife, the blade is actuated via a sliding rack-and-gear mechanism. While these designs allow for the knife to be quickly deployed, the actuation mechanisms are not particularly robust, and it is difficult to lock the blades in an open position. Additionally, separable tethers can oftentimes become disengaged unintentionally, or they can be too difficult to disengage. Further, the weight of the knife itself may cause the blade to inadvertently partially or fully deploy when the knife is dangled at the end of the separable tether, and the direction of blade deployment does not lend itself to quick use or safety. More specifically, to deploy the folding knife in Gaffney, one would have to carefully grasp the handle so that the path of the blade is not obstructed. With the sliding knife in Gaffney, to leave the blade in its most useful position (e.g., in a cutting position with the blade extending away from the thumb and forefinger, as opposed to an overhand stabbing position, with the blade extending down from the pinky), one would have to either grasp the knife handle in an underhanded fashion, or turn the knife over subsequent to deployment.

Another "one-handed" knife is shown in U.S. Pat. No. 5,878,500 to Emerson ("Emerson"). There, a folding knife is provided with a special sheath. The back of the knife blade has a hook, and the inside of the sheath is provided with a complementary lip. As the knife is pulled out of the sheath, the hook on the blade encounters the lip on the inside of sheath, which causes the blade to swing open as the knife is extracted. While this design facilitates quick blade deployment, it is still necessary to reach into the sheath to grasp the knife. Additionally, the lip and hook may become misaligned when the knife is withdrawn from the sheath, in which case the blade will not automatically deploy.

Accordingly, it is a primary object of the present invention to provide a sliding knife whose blade can be actuated with one hand.

Another primary object of the present invention is to provide a sliding knife that can be worn on (or attached to) the body, and that can be simultaneously detached from the body and deployed, with one hand.

Another object of the present invention is to provide a "one-handed" sliding knife that has both a robust blade deployment mechanism and a robust, secure blade locking system.

SUMMARY

A sliding knife with disengaging blade actuation mechanism comprises: a hollow handle; a blade having a detent near its base end and slidable within the handle between a first, fully retracted position and a second, deployed position; and a disengaging blade actuation mechanism, called a "tongue," which fits over the blade and within the handle, and has a ball dimensioned to fit within the blade's detent. In use, the blade is extended and retracted via the tongue. More specifically, in a retracted position, the blade and tongue lie within the handle, with an end portion of the tongue being accessible from outside the handle. When the tongue is grasped and pulled away from the handle, the tongue pulls the blade along with it (i.e., the blade is extended by way of the ball pulling on the edge of the detent). Then, once the blade is fully extended, the tongue lies outside the handle, and is free to disengage from the blade and handle. Thus, the tongue can be affixed to a person's clothing, with the handle dangling down therefrom, and all that is needed to activate the knife (e.g., extend the blade and disengage the tongue) for use is to yank down on the handle with one hand. The knife is also provided with locking mechanisms for securing the blade in its deployed and retracted positions.

BRIEF DESCRIPTION OF THE DRAWINGS

These and other features, aspects, and advantages of the present invention will become better understood with respect to the following description, appended claims, and accompanying drawings, in which:

FIGS. 9H and 9I are a plan view and a cross-sectional view, respectively, of a contoured spring portion of the fourth embodiment of the sliding knife, while

FIG. 15A shows a plan view of an alternative embodiment of a knife blade according to the present invention, while

DETAILED DESCRIPTION

Figures 1A, 1B, 1C:
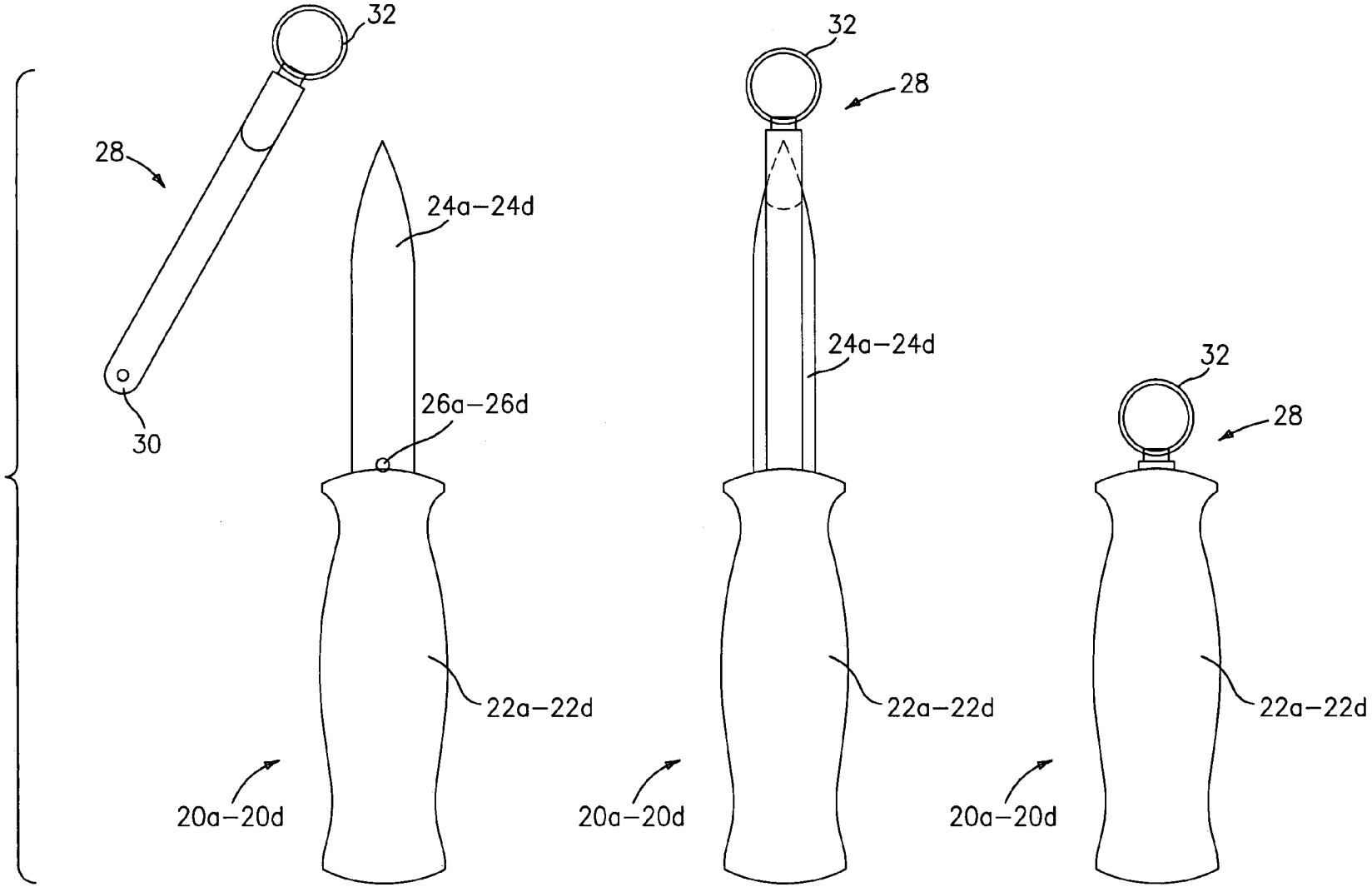
FIG. 1A is a plan view showing a sliding knife with disengaging blade actuation mechanism, according to the present invention, in a retracted position.
FIG. 1B is a plan view of the sliding knife in an intermediate position.
FIG. 1C is a plan view of the sliding knife in a deployed position.
Figure 3A:
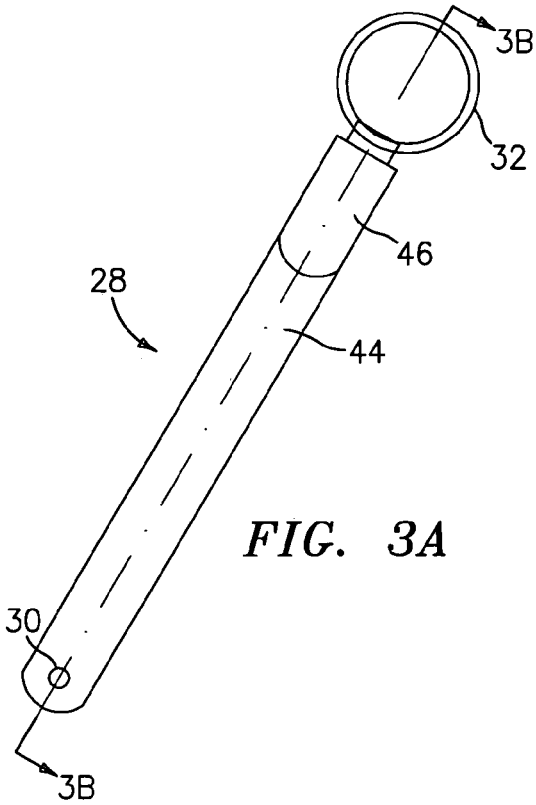
FIG. 3A is a plan view of a blade actuation mechanism, or "tongue," for use with the sliding knife.
Figure 2B:
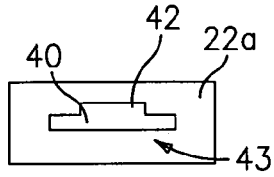
FIG. 2B is an end view of a handle portion of the first embodiment of the sliding knife.
Figure 3B:
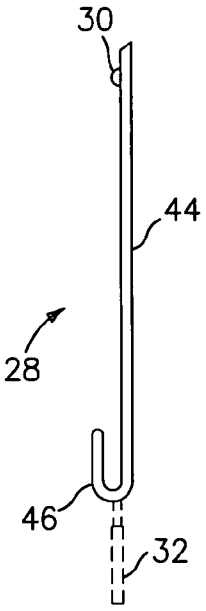
FIG. 3B is a cross-sectional view of the tongue.
Figure 2A:
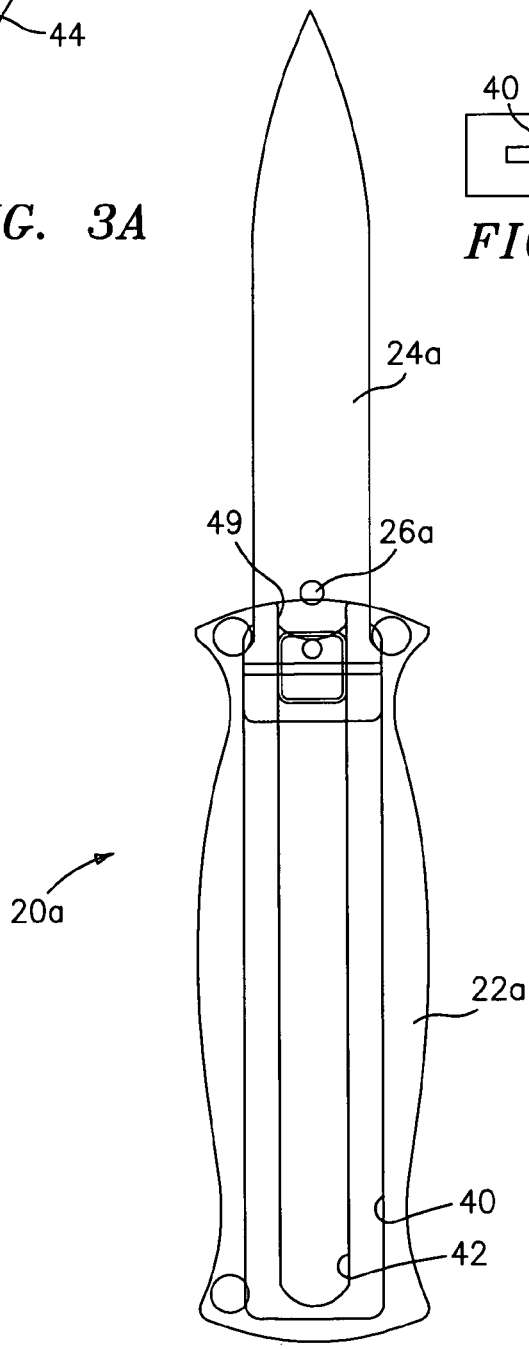
FIG. 2A is a plan view, showing some internal details, of a first embodiment of the sliding knife according to the present invention.

Turning now to FIGS. 1A–11G, various embodiments of a sliding knife with disengaging blade actuation mechanism 20*a*–20*d*, according to the present invention, will now be described. Each knife 20*a*–20*d* generally comprises: a hollow handle 22*a*–22*d*; a blade 24*a*–24*d* having a detent 26*a*–26*d* near the base end of the blade and slidable within the handle between a first, fully retracted position and a second, deployed or extended position; and a disengaging blade actuation mechanism 28, called a "tongue," which fits over the blade and within the handle, and has a ball 30 dimensioned to fit within the detent 26*a*–26*d* of the blade. In use, the blade 24*a*–24*d* is extended and retracted via the tongue 28. With reference to FIG. 1A, in a retracted position, the blade and tongue lie within the handle 22*a*–22*d*. When the tongue 28 is pulled away from the handle 22*a*–22*d*, e.g., by grasping and pulling a ring 32 affixed to the end of the tongue 28, the blade 24*a*–24*d* is extended, as shown in FIG. 1B, via the ball 30 pulling on the edge of the detent 26*a*–26*d*. Then, the tongue 28 disengages from the blade 24*a*–24*d*, as shown in FIG. 1C. Thus, the ring 32 or tongue 28 can be affixed to a person's clothing, with the handle 22*a*–22*d* dangling down therefrom, and all that is needed to activate the knife (e.g., extend the blade and disengage the tongue) for use is to yank down on the handle with one hand. The knife 20*a*–20*d* also has locking mechanisms for securing the blade 24*a*–24*d* in its deployed and retracted positions, as further discussed below.

FIGS. 2A–4B show a first embodiment of the sliding knife 20*a*. Here, the hollow handle 22*a* has a main longitudinal slot 40 and a secondary longitudinal slot 42 (see FIG. 2A), which define a fore opening 43 in the handle (note that the main slot 40 narrows at the opening 43). Additionally, the blade 24*a* is slidable within the main slot 40, while the tongue 28 is slidable within the secondary slot 42. The tongue 28 comprises a thin, elongate extension member 44 that fits within the secondary slot 42, a U-shaped cap or lip portion 46, the ball 30 at the end of the extension 44, and, optionally, the ring 32, which is used as a means for pulling the tongue 28 away from the handle 22*a* and/or as a means to attach the tongue 28 to clothing or some other object. The ball 30 is dimensioned to fit within the detent 26*a* at the base of the blade 24*a*, while the rest of the tongue 28 is dimensioned to fit over the blade 24*a* when the ball 30 is positioned within the detent 26*a* (i.e., with the ball in the detent, the tongue can be pivoted such that the tip of the blade lies nestled between the extension and the lip portion of the tongue, as shown in FIG. 4A). The clearance between the lip 46 and the extension 44 of the tongue 28 should be sufficient to allow the tip of the blade 24*a* to pass there between, with or without a slight friction engagement.

As briefly discussed above, FIGS. 1A–1C show how the knife 20*a* is actuated. In FIG. 1A, the blade 24*a* is retracted, lying within the handle 22*a*. The ring 32 and end of the tongue 28 lie beyond the handle fore opening 43. To actuate the knife 20*a*, the handle 22*a* is pulled firmly away from the ring 32 and/or tongue 28 (or, correspondingly, the ring and tongue may be firmly pulled away from the handle). With the tongue 28 engaging the blade 24*a* (via the ball 30 and detent 26*a*), the relative movement between the tongue 28 and handle 22*a* causes the blade 24*a* to slide along the main slot 40, and the tongue 28 to slide along the secondary slot 42. The blade 24*a* fully extends and locks in place (as further discussed below with respect to FIGS. 4A and 4B), as shown in FIG. 1B. At this point, the tongue 28 is no longer within the secondary slot 42, and naturally disengages from the blade 24*a*, as shown in FIG. 1C. To retract the blade, the process is reversed, as further discussed below.

Figure 4A:
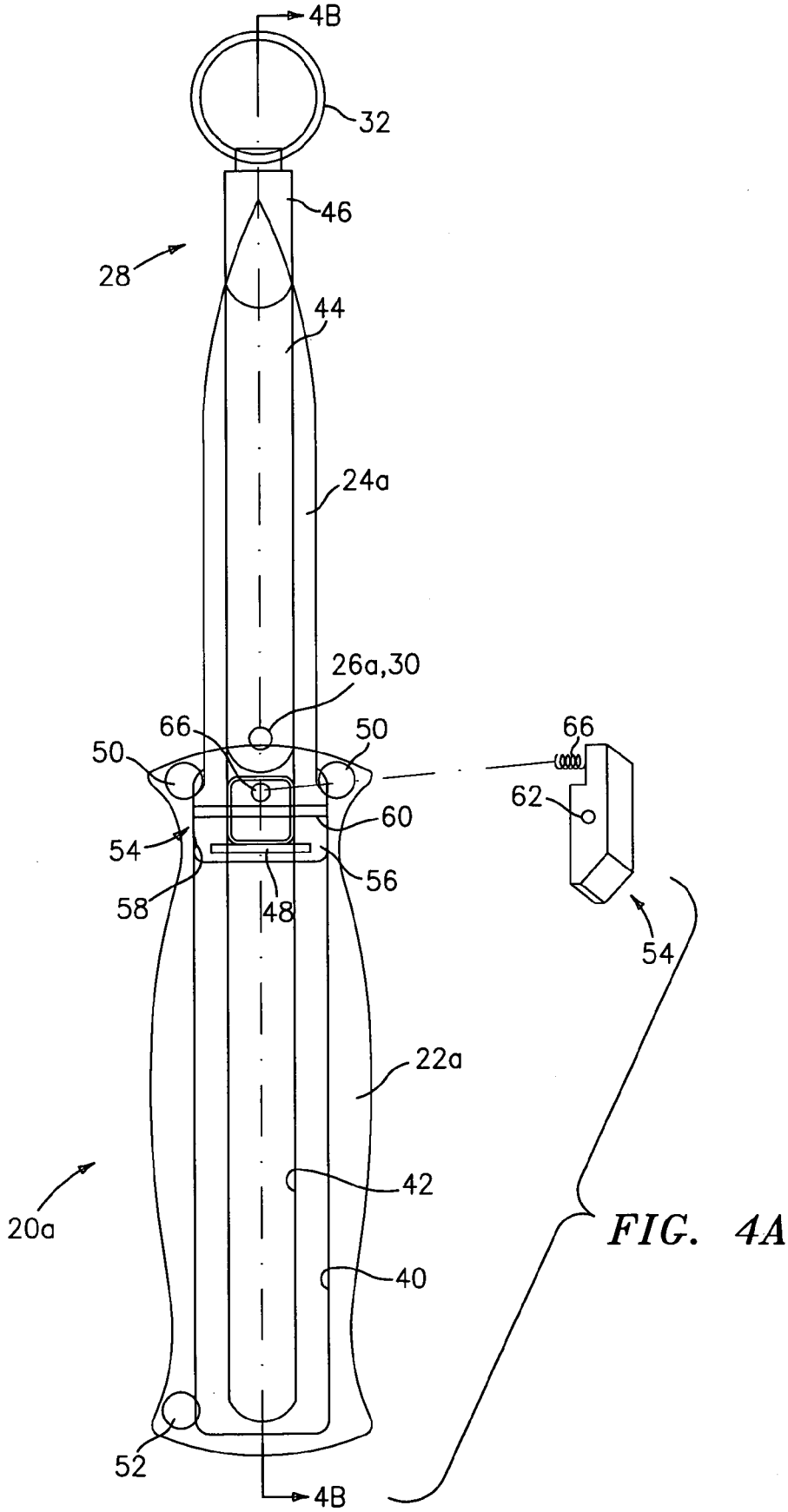
FIG. 4A is a plan view of the first embodiment of the sliding knife, showing internal detail, with the tongue in place about the blade, and also including a perspective view of a pivoting sear for use in locking the knife blade in an open position.
Figure 4B:
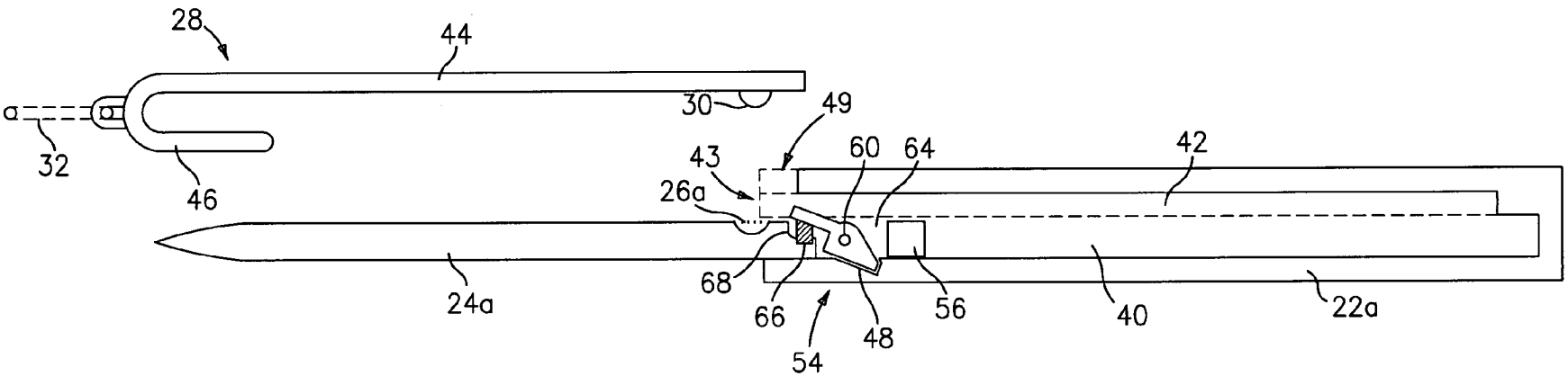
FIG. 4B is a cross-section view of the knife shown in FIG. 4A, with the tongue displaced for clarity.

FIGS. 4A and 4B show the internal operational mechanism of the knife 20*a*. As can be seen, the knife 20*a* further includes a fore-facing sear groove 48 provided in the handle 22*a*, a tongue clearance notch 49 also provided in the handle 22*a*, two forward internal urethane bumpers 50, a rear internal urethane bumper 52, and a blade deployment locking mechanism in the form of a spring-loaded sear 54. The blade has a widened base 56 that fits within the main slot 40, and a side notch 58. As should be appreciated, while the fore portion of the blade (e.g., the edged portion) can pass through the forward opening 43 of the handle 22*a*, the base 56 of the blade is too wide to do so.

The sear 54 is pivotally attached to the base 56 of the blade 24*a* via a cross pin 60 extending through a hole 62 in the sear 54. As best seen in FIG. 4B, the sear 54 is pivotally disposed within an opening 64 provided in the rear 56 of the blade 24*a*, and is biased to pivot in a clockwise direction (with reference to FIG. 4B) by a spring element 66 attached to or abutting the blade 24*a*. A recess 68 is provided in the blade by the opening 64 for holding the spring element 66 and for allowing a fore portion of the sear 54 to pivot below the top surface of the blade 24*a*.

When the blade 24*a* is retracted (e.g., as in FIG. 1A) within the handle 22*a*, the tongue 28 lies on top of the blade 24*a* in the secondary slot 42, with the ball 30 in the blade detent 26*a*. In this position, the tongue presses down on the sear 54, causing it to pivot counter-clockwise (again, with reference to FIG. 4B). Also, the side notch 58 in the blade engages the rear bumper 52. This acts as a mechanism (i.e., a friction lock) for securing the blade in its retracted position, preventing the blade from falling opening, but also allowing for the blade to be pulled along with the tongue 28 (i.e., the friction lock should prevent the knife from opening due to the force of gravity acting upon the handle and blade, but should come unlocked when a person pulls the handle away from the tongue manually, i.e., exerts a "manual" force on the tongue).

When a user firmly pulls the handle 22*a* away from the tongue 28 for deploying the blade 24*a*, the tongue 28 causes the blade 24*a* to extend out through the fore opening 43 of the handle 22*a*. When the blade reaches its fully extended position, the two forward bumpers 50 (small, semi-flexible plastic discs) depress slightly and absorb the shock, and the rear portion of the pivoting sear 54 clears a rear edge of the sear groove 48 provided in the handle 22*a*. At the same time, the tongue 28 is no longer in the secondary slot 42 (e.g., it has reached the clearance notch 49), allowing the spring 66 to pivot the sear 54 clockwise, with the rear portion of the sear 54 engaging the sear groove 48. The bumpers 50 also apply a rearwards pressure on the blade 24*a* that ensures a solid lock between the sear 54 and the sear groove 48. The blade 24*a* cannot be pushed back into the handle without using the tongue 28.

Once the tongue 28 reaches the clearance notch 49, the ball 30 naturally disengages from the detent 26*a* in the blade 24*a*, and the tongue falls away from the blade. Thus, the blade 24*a* is fully exposed for use. Additionally, if the knife 20*a* was being worn or was attached to clothing by way of the tongue 28, once the tongue 28 disengages, the handle 22*a* and blade 24*a* are free for immediate use.

To retract the blade 24*a*, the ball 30 of the tongue 28 is set into the detent 26*a* in the blade 24*a*, and the tongue is rotated to place the tongue lip 46 over the tip of the blade 24*a* (or, the blade tip can first be "sheathed" and then the tongue can be rotated into place). With the ball in the detent, the end of the tongue extension 44 overlaps the forward edge of the sear 54. Pushing down on the tongue 28 causes the sear 54 to pivot against the action of the spring 66, causing the sear 54 to disengage from the sear groove 48. This allows the blade and the tongue (which is aligned with the secondary longitudinal slot 42) to be inserted into the handle 22*a* at the same time. More specifically, the blade slides along the main slot 40 while the tongue slides along the secondary slot 42. Once fully retracted, the blade 24*a* "locks" into place via the rear bumper 52 engaging the blade notch 58.

FIGS. 5A–5H and 6A–6F show a second embodiment of the sliding knife 20*b*. Here, the overall operation of the knife is generally as described above with respect to FIGS. 1A–1C, but the locking mechanism for holding the blade 24*b* in its deployed position comprises a locking pin-and-spring mechanism, as explained in further detail below.

Figure 5B:
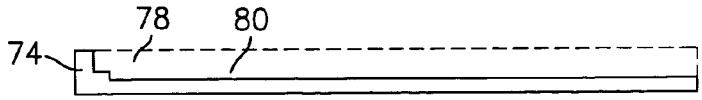
FIGS. 5A–5F are various views of the handle components of a second embodiment of the sliding knife with disengaging blade actuation mechanism.
Figure 5A:
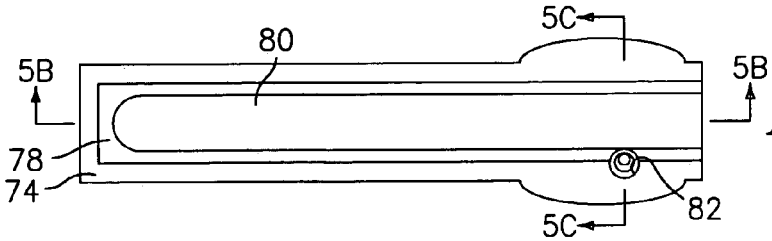
Figure 5E:
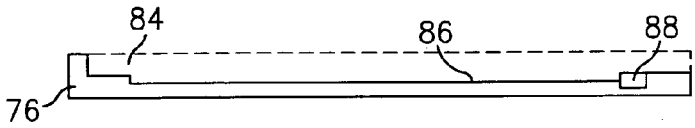
Figure 5D:
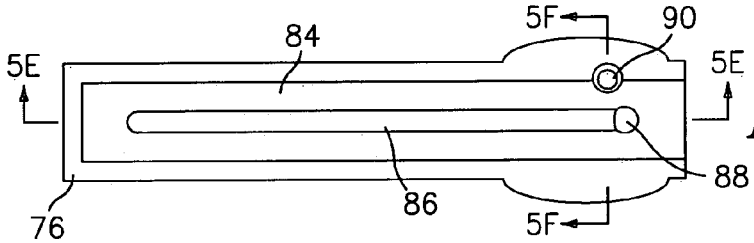
Figure 5K:
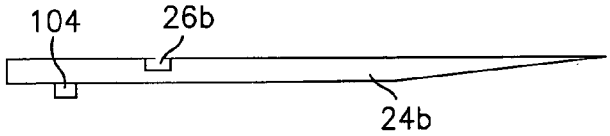
FIGS. 5G–5K are various views of a blade portion of the second embodiment of the sliding knife.
Figure 5I:
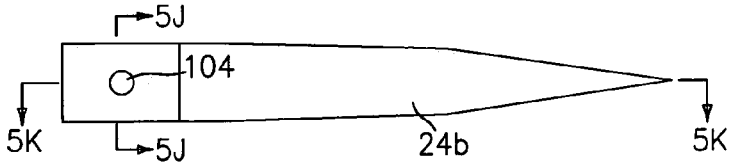
Figure 5G:
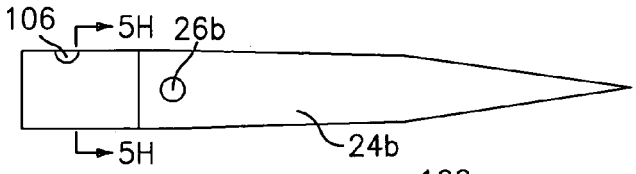
Figure 5C:
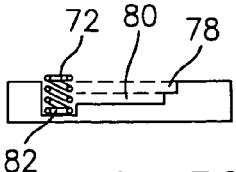
Figure 5F:
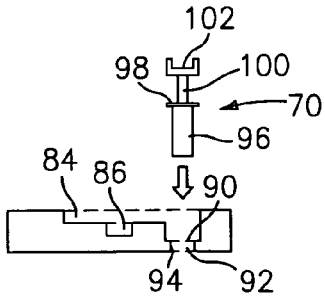
Figure 5J:
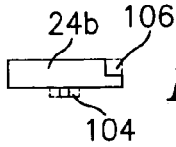
Figure 5H:
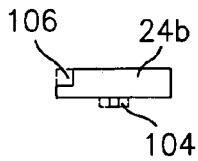

FIGS. 5A–5H show the components of the second embodiment of the sliding knife 20*b*. The knife 20*b* comprises the handle 22*b*, the blade 24*b*, and the locking pin-and-spring mechanism, which includes a lock pin 70 and a compression spring 72. The handle 22*b* comprises a first, or "top" half 74 and a second, or "bottom" half 76. The top half 74 defines a main longitudinal slot 78 for the blade 24*b* and a secondary longitudinal slot 80 for the tongue 28. Also, a spring recess 82 for holding the spring 72 is located towards one end of the handle half 74. The bottom handle half 76 also defines a main longitudinal slot 84 and a narrow, central guide track 86, which terminates at one end at a bumper 88. As should be appreciated, when the two handle halves are united, the two main longitudinal slots 78 and 84 together define a space dimensioned to accommodate the blade 24*b*. The bottom handle half 76 also includes a lock-pin throughway 90, which includes a narrowed opening 92 defined by a flange 94. Also, as shown in FIG. 5F, the lock pin 70 comprises an actuation shaft 96 dimensioned to fit through the opening 92, a lip 98 dimensioned to fit within the throughway 90, a neck 100 extending up from the lip 98, and a concave cap 102 into which the spring 72 fits. The blade 24*b*, as shown in FIGS. 5G–5K, includes a tab 104 dimensioned to fit within the guide track 86 on one side of the blade, a side notch 106, and the detent 26*b* on the other side of the blade.

Figure 6A:
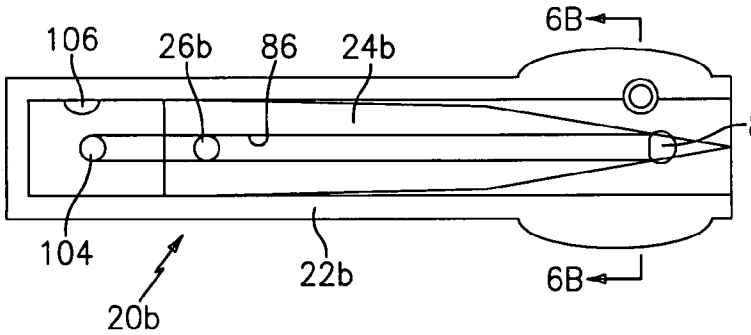
FIGS. 6A–6F are plan and cross-sectional views of the second embodiment of the sliding knife in a retracted position (FIGS. 6A & 6B), an intermediate position (FIGS. 6C & 6D), and a deployed position (FIGS. 6E & 6F)
Figure 6B:
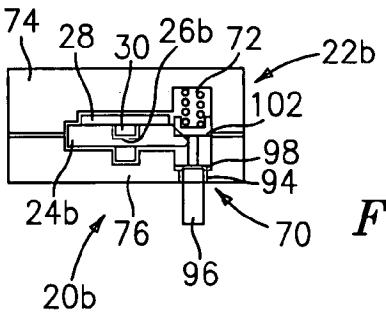

FIGS. 6A–6F show the operation of the second knife embodiment 20*b*. In a retracted position, as shown in FIGS. 6A and 6B, the blade 24*b* lies within the confines of the handle 22*b*, within the space defined by the longitudinal slots 78, 84 of the two handle halves 74, 76. The tab 104 lies at the end of the guide track 86 away from the bumper 88. The lock pin 70 lies out of the way of the blade, and is held fully within the throughway 90, with the lip 98 abutting the flange 94, by the spring 72 pushing against the lock pin cap 102. Additionally, the tongue 28, lying within the secondary slot 80, is positioned over the blade, with the ball 30 in the detent 26*b* (see FIGS. 6A and 6D).

Figure 6C:
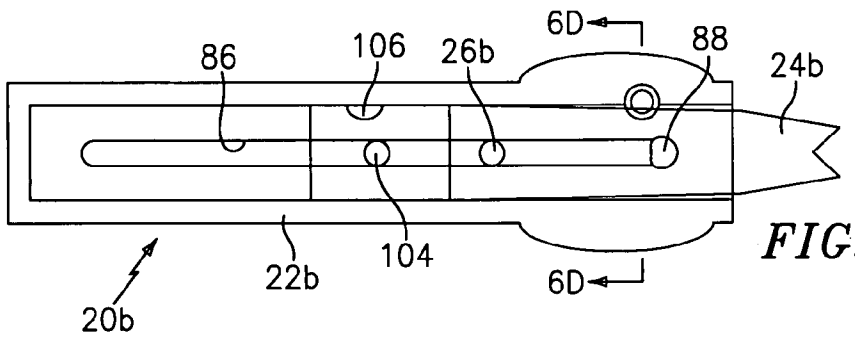
Figure 6D:
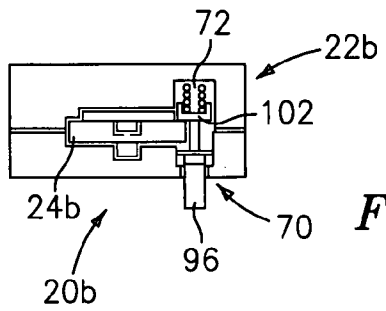

As the tongue 28 is pulled away from the handle 22*b* (or vice versa), the tongue 28 pulls the blade 24*b* along with it, via the ball 30 and detent 26*b*, as shown in FIGS. 6C and 6D. The tab 104 on the blade slides along the guide track 86 in the handle. Additionally, the blade 24*b* encounters the lock pin 70, causing the lock pin to move up against the operation of the spring 72, as shown in FIG. 6D. In this position, the cap 102 rides along the top of the blade 24*b*.

Figure 6E:
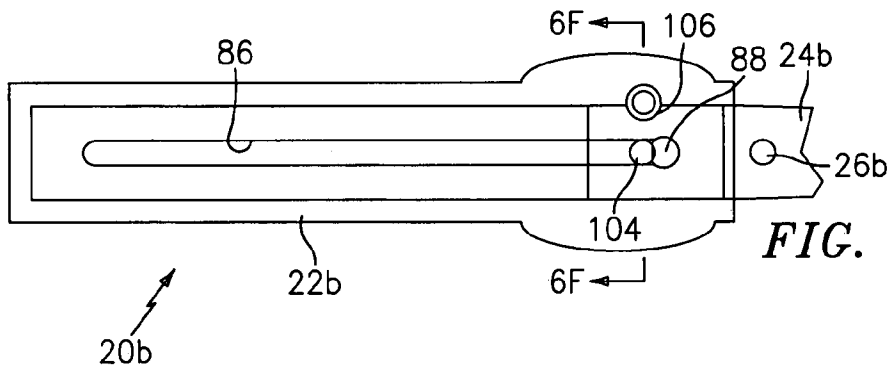
Figure 6F:
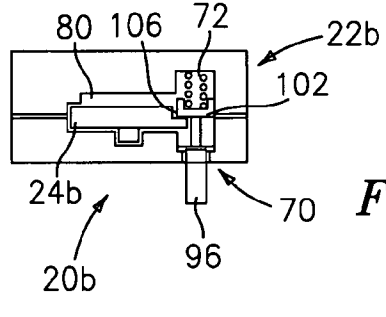

As the tongue 28 is further pulled away from the handle, the blade 24*b* eventually reaches its fully deployed position, as shown in FIGS. 6E and 6F. Here, the tab 104 reaches the end of the track 86, and encounters the bumper 88, which acts as a shock absorber. Further, in this position, the blade side notch 106 aligns with the lock pin 70, allowing the spring 72 to push the cap 102 of the lock pin within the side notch 106, locking the blade into place. Also, the blade detent 26*b* clears the handle, allowing the tongue 28 to disengage. To retract the blade, the tongue 28 is placed over the blade 24*b* with the ball 30 in the detent 26*b*. Then, the actuation shaft 96 of the lock pin 70 is pushed, compressing the spring 72 and causing the cap 102 to exit the blade side notch 106. Subsequently, the tongue 28 and blade 24*b* are pushed inwards into the handle.

As should be appreciated, the second embodiment of the sliding knife 20*b* can be provided with a rear bumper for engaging a side notch provided on the blade when the blade is retracted, for holding the blade in its retracted position.

FIGS. 7A–8D show a third embodiment of the sliding knife with disengaging blade actuation mechanism 20*c*. Here, again, the operation of the knife 20*c* is generally as described above with respect to FIGS. 1A–1C, but the locking mechanism for holding the blade 24*c* in its deployed position comprises a locking spring-and-ball mechanism, as explained in further detail below.

Figure 7A:
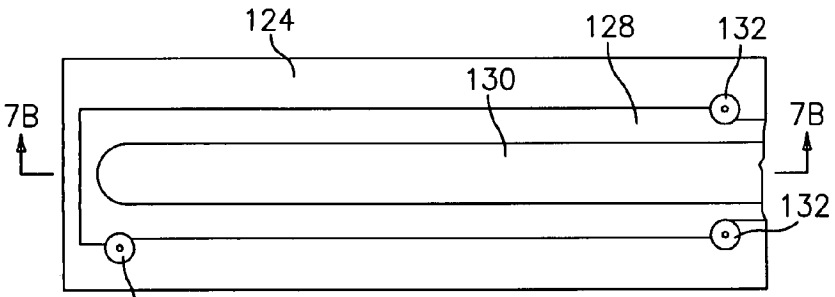
FIGS. 7A–7D are various views of the handle components of a third embodiment of the sliding knife with disengaging blade actuation mechanism.
Figure 7B:
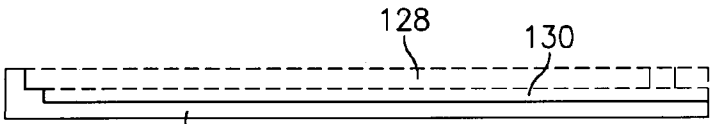
Figure 7D:
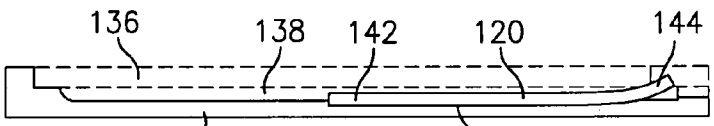
Figure 7C:
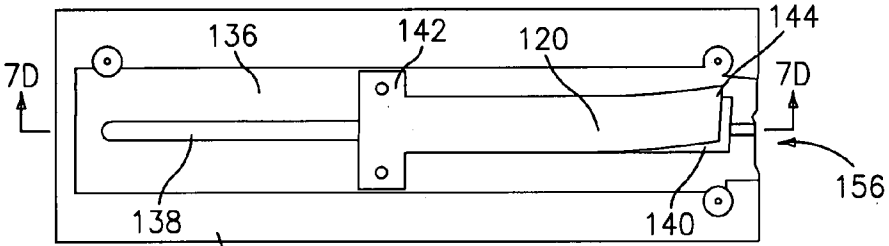

FIGS. 7A–7G show the components of the third embodiment of the sliding knife 20*c*. The knife 20*c* comprises the handle 22*c*, the blade 24*c*, and the locking spring-and-ball mechanism, which comprises a plate spring 120 and a ball 122 (see FIGS. 8A–8D). The handle 22*c* comprises a first, or "top" half 124 and a second, or "bottom" half 126. The top half 124 defines a main longitudinal slot 128 for the blade 24*c* and a secondary longitudinal slot 130 for the tongue 28. Also, two forward bumpers 132 and a rear bumper 134 are provided, all of which partially protrude into the main slot 128. The bottom handle half 126 also defines a main longitudinal slot 136, a rounded ball guide track 138, and a plate spring recess 140, which lies below the ball guide track 138. The plate spring 120 is positioned within the spring recess 140, with a stanchion end 142 of the plate spring fastened to the bottom handle half 126, and with a fore end 144 of the spring extending upwards, as shown in FIGS. 7C and 7D. The stanchion end 142 of the plate spring will typically lie below the main longitudinal slot 136, although it does not necessarily have to be flush with the level of the ball guide track 138.

Figure 7E:
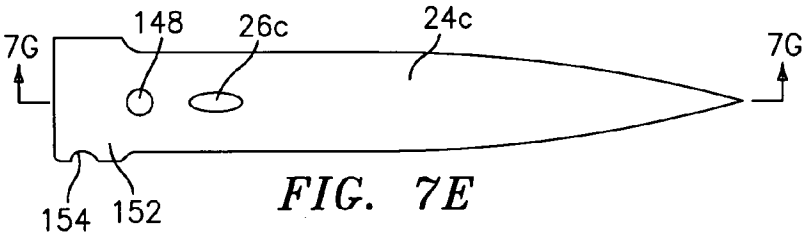
FIGS. 7E–7G are various views of a blade portion of the third embodiment of the sliding knife.
Figure 7F:
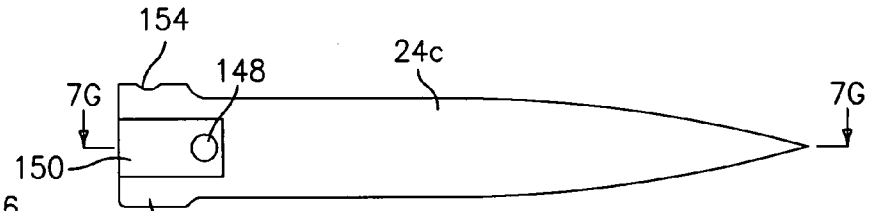
Figure 7G:
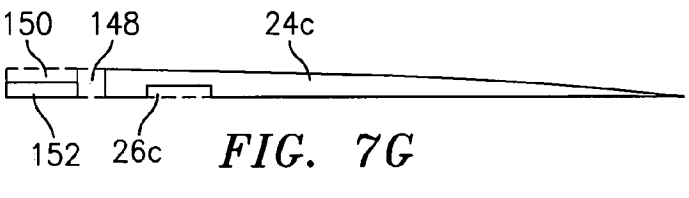

The blade 24*c*, as shown in FIGS. 7E–7G, includes the detent 26*c* (in this case, elongated) on one side of the blade, a round ball passage 148 extending through the blade, and a spring-engagement clearance 150 on the other side of the blade and extending from the passage 148 to the end of the blade. The base 152 of the blade is wider than the edged portion, and is provided with a blade side notch 154.

As should be appreciated, when the two handle halves 124, 126 are united, the two main longitudinal slots 128, 136 together define a space dimensioned to accommodate the blade 24*c*. As with the first embodiment of the sliding knife 20*a*, the forward opening 156 of the longitudinal slots is narrowed, such that the fore portion of the blade 24*c* (e.g., the edged portion) can extend beyond the handle 22*c*, while the base 152 of the blade cannot.

Figures 8A, 8B, 8C, 8D:
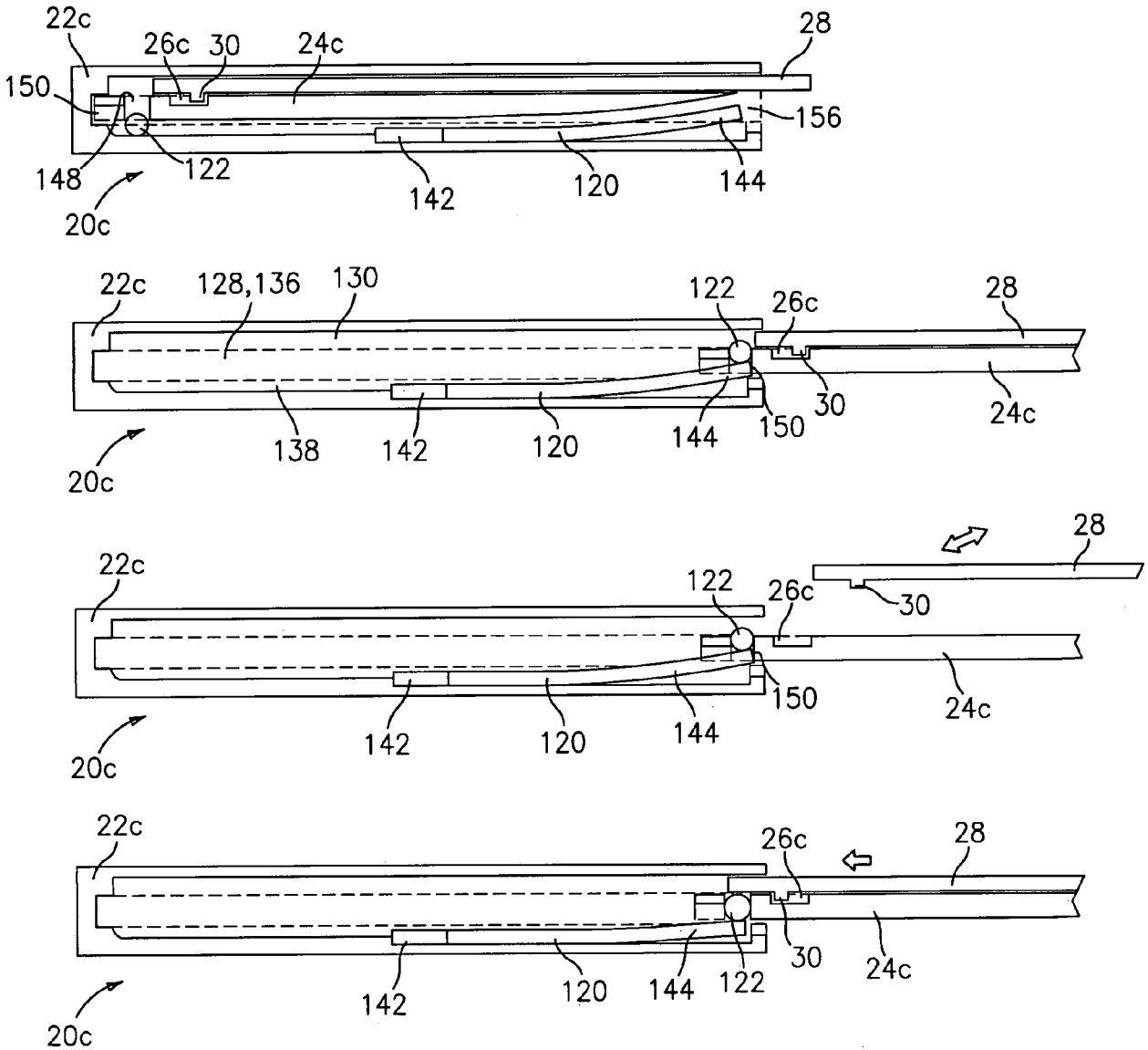
FIGS. 8A–8D are various views showing operation of the third embodiment of the sliding knife.

FIGS. 8A–8D show how the third embodiment of the sliding knife 20*c* operates. In a retracted position, as shown in FIG. 8A, the blade 24*c* lies within the confines of the handle 22*c*. The ball 122, having been placed in the blade's ball passage 148, lies partially within the ball guide track 138 (as shown in FIG. 8A) or the secondary slot 130, depending on how the knife 20*c* is oriented. In either case, the ball 122 remains partially within the ball passage 148, since neither the track 138 nor the secondary slot 130 are deep enough to permit the ball 122 to exit the ball passage 148. Also, the tongue 28 lies on top of the blade 24*c*, with the ball 30 in the elongated blade detent 26*c*. To deploy the blade 24*c*, the handle 22*c* is pulled away from the tongue 28 (or vice versa). The tongue 28 pulls the blade 24*c* along with it, causing the blade to slide along the main longitudinal slot and extend through the handle opening 156.

As the blade is extended, the ball 122 moves along with the blade. Thus, with respect to the orientation shown in FIGS. 8A and 8B, when the ball 122 reaches the spring 120, the ball moves along the top of the spring. As the blade reaches its fully deployed position, as shown in FIGS. 8B and 8C, the tongue 28 clears the handle, and disengages from the blade, and the base 152 of the blade encounters the forward bumpers 132, which absorb any shock. Additionally, the fore end 144 of the plate spring 120, dimensioned to fit within the clearance 150, clears the edge of the spring-engagement clearance 150 on the blade 24*c*, and springs into place in the clearance 150. The spring 120 abuts the blade, locking it into place. Additionally, the spring causes the ball 122 to lie partially within the secondary slot 130, e.g., in the ball passage 148 between the handle 22*c* and the fore end 144 of the spring 120.

To retract the blade 24*c*, the tongue 28 is placed over the blade with the ball 30 in the elongate detent 26*c*, as shown in FIG. 8B. As can be seen, in this position the tongue 28 is aligned with the secondary slot 130. Then, the tongue 28 is pushed rearwards, as shown in FIG. 8D, causing the tongue ball 30 to track along the elongate detent 26*c*. This allows the end of the tongue 28 proximate the ball 30 to extend into the secondary slot, without the tongue acting to push rearwards on the blade. As the tongue enters the secondary slot, it encounters the locking ball 122, which it forces downwards against the spring 120. The ball 122 and other elements are dimensioned such that once the tongue 28 has fully pushed the ball downwards, the plate spring 120 is clear of the spring-engagement clearance 150 on the blade 24*c*. With the spring 120 no longer locking the blade in place, pushing the tongue 28 further rearwards causes the blade 24*c* to also move rearwards, via the tongue ball 30 pushing on the rear of the elongate blade detent 26*c*. Once the blade is fully retracted, the rear bumper 134 engages the blade side notch 154, holding the blade in its retracted position.

FIGS. 9A–11G show a fourth embodiment of the sliding knife with disengaging blade actuation mechanism 20*d*. Here, again, the operation of the knife 20*d* is generally as described above with respect to FIGS. 1A–1C, but the locking mechanism for holding the blade 24*d* in its deployed position comprises a locking contoured spring and blade shoulder mechanism, as explained in further detail below.

FIGS. 9A–9J show the components of the fourth embodiment of the sliding knife 20*d*. The knife 20*d* comprises the handle 22*d*, the blade 24*d*, and the contoured spring and blade shoulder mechanism, which comprises a contoured plate spring 180 attached to the handle 22*d*, and, on the base portion 182 of the blade 24*d*, a rear-facing shoulder 184 with center slide 186. The handle 22*d* comprises a first, or "top" half 188 and a second, or "bottom" half 190. The top half 188 defines a main longitudinal slot 192 for the blade 24*d*, a secondary longitudinal slot 194 for the tongue 28, a spring recess 196 below the level of the secondary slot 194, and a spring clearance depression 198 below the level of the spring recess 196. The bottom handle half 190 defines a main longitudinal slot 200, which is dimensioned to mate with the main longitudinal slot 192 of the top handle half 188, for providing a space for the blade 24*d*. Also, both handle halves define spaces for accommodating two forward bumpers 202 and a rear bumper 204, all of which partially protrude into the main slots 192, 200.

The contoured spring 180 is positioned within the spring recess 196, and includes a stanchion end 206, a "downwards" extending center portion 208, and an "upturned" detachment lip 210. Together, the center portion 208 and lip 210 define a pair of shoulders 211. The stanchion end 206 of the spring 180 is attached to the top handle half 188 such that the center portion 208 of the spring extends away from the top handle half and the detachment lip 210 extends back towards the top handle half. The stanchion end 206 of the spring lies below the level of the secondary slot 194.

Figure 9A:
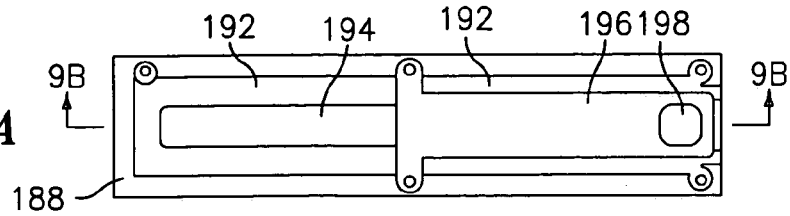
FIGS. 9A–9D are various views of the handle components of a fourth embodiment of the sliding knife with disengaging blade actuation mechanism.
Figure 9B:
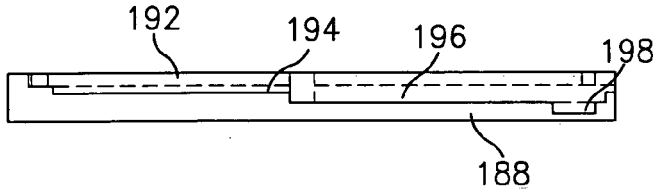
Figure 9C:
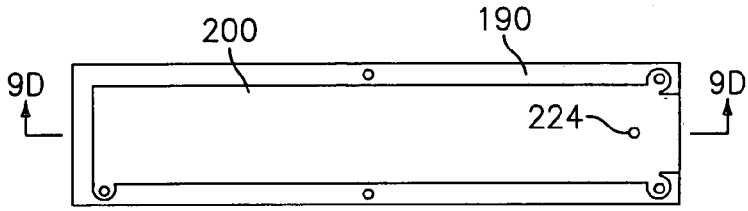
Figure 9D:
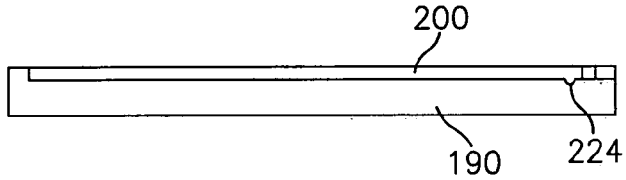
Figure 9E:
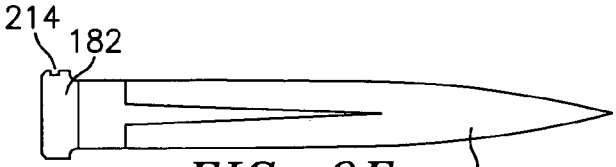
FIGS. 9E–9G & 9J are various views of a blade portion of the fourth embodiment of the sliding knife.
Figure 9F:
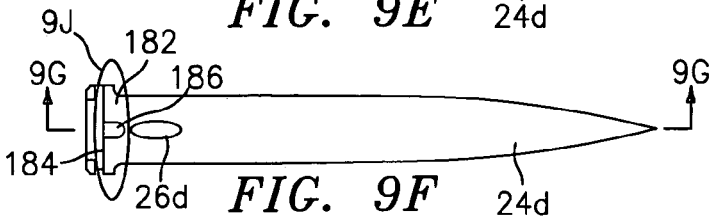
Figure 9G:
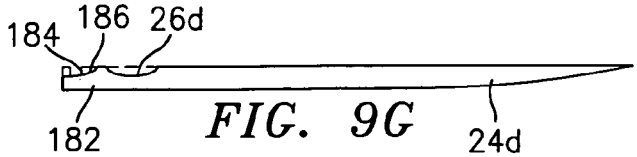
Figure 9I:
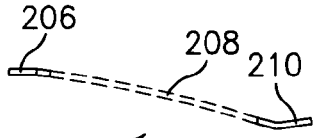
Figure 9J:
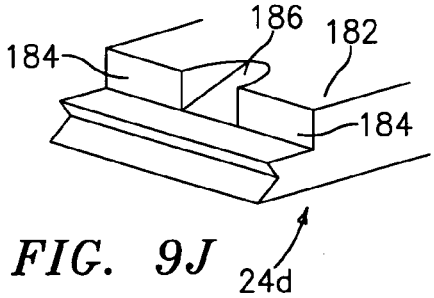

Finally, the blade 24*d* includes the rear-facing shoulder 184, the slide 186, and the detent 26*d* (in this case, elongated). As can be seen in FIGS. 9F, 9G, and 9J, the slide extends from the center of the shoulder 184 up to the top surface of the blade near one end of the elongate detent 26*d*. The blade 24*d* also includes a side notch 214.

As should be appreciated, when the two handle halves 188, 190 are united, the two main longitudinal slots 192, 200 together define a space dimensioned to accommodate the blade 24*d*. As with the first embodiment of the sliding knife 20*a*, the forward opening 216 of the longitudinal slots is narrowed, such that the fore portion of the blade 24*d* (e.g., the edged portion) can extend beyond the handle 22*d*, but the base 182 of the blade cannot.

Figure 9H:
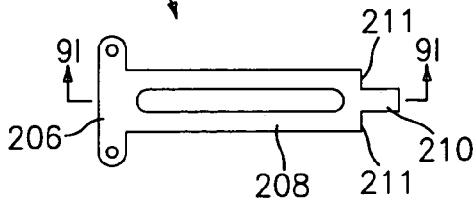
Figure 9K:
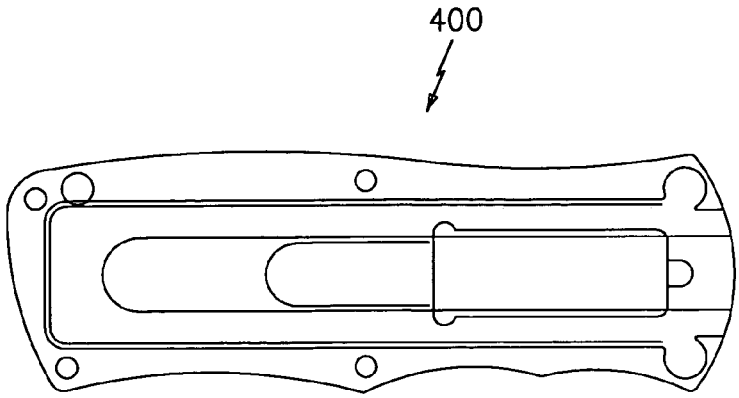
FIGS. 9K–9O are alternative embodiments of the components shown in FIGS. 9A–9J.
Figure 9L:
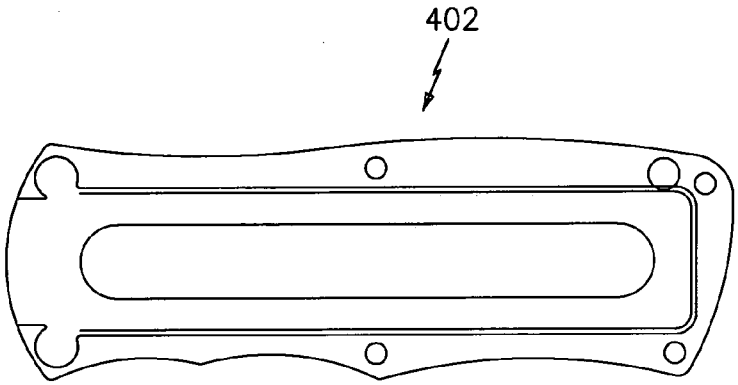
Figure 9M:
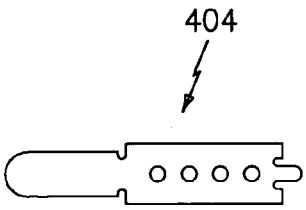
Figure 9N:
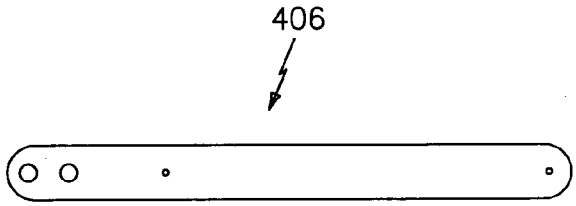
Figure 9O:
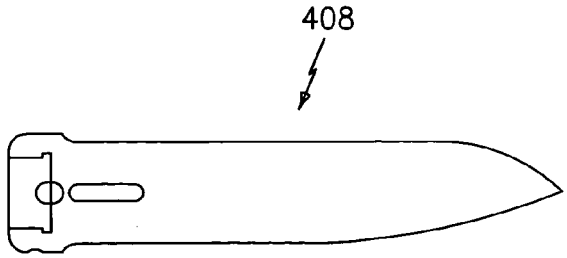

FIGS. 9K–9O show alternative, though similar embodiments of the components shown in FIGS. 9A–9J for the sliding knife 20*d*. More specifically, FIG. 9K shows a first, or "top" half 400 of a handle, while FIG. 9L shows a second, or "bottom" half 402. These handle halves are suitable for use with a contoured plate spring 404, as shown in FIG. 9M. The plate spring 404 is similar in function and makeup to the plate spring 180, but is meant to be press fit into the handle 400 (adhesives or fasteners may be used to further secure the plate spring 404), thereby obviating the need for a more complex attachment mechanism. FIGS. 9N and 9O show an alternative tongue 406 and blade 408, respectively.

Figure 10A:
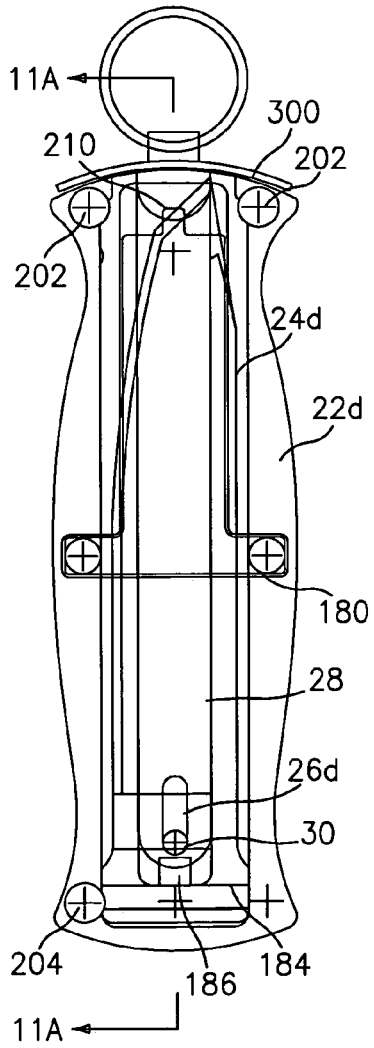
FIGS. 10A–10D are various plan views of the fourth embodiment of the sliding knife, including internal details, showing how the knife operates.
Figure 10B:
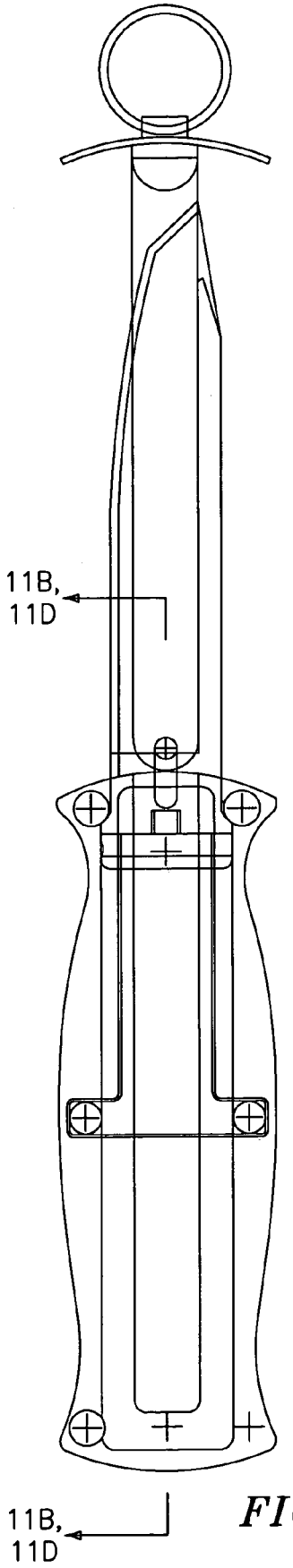
Figure 10C:
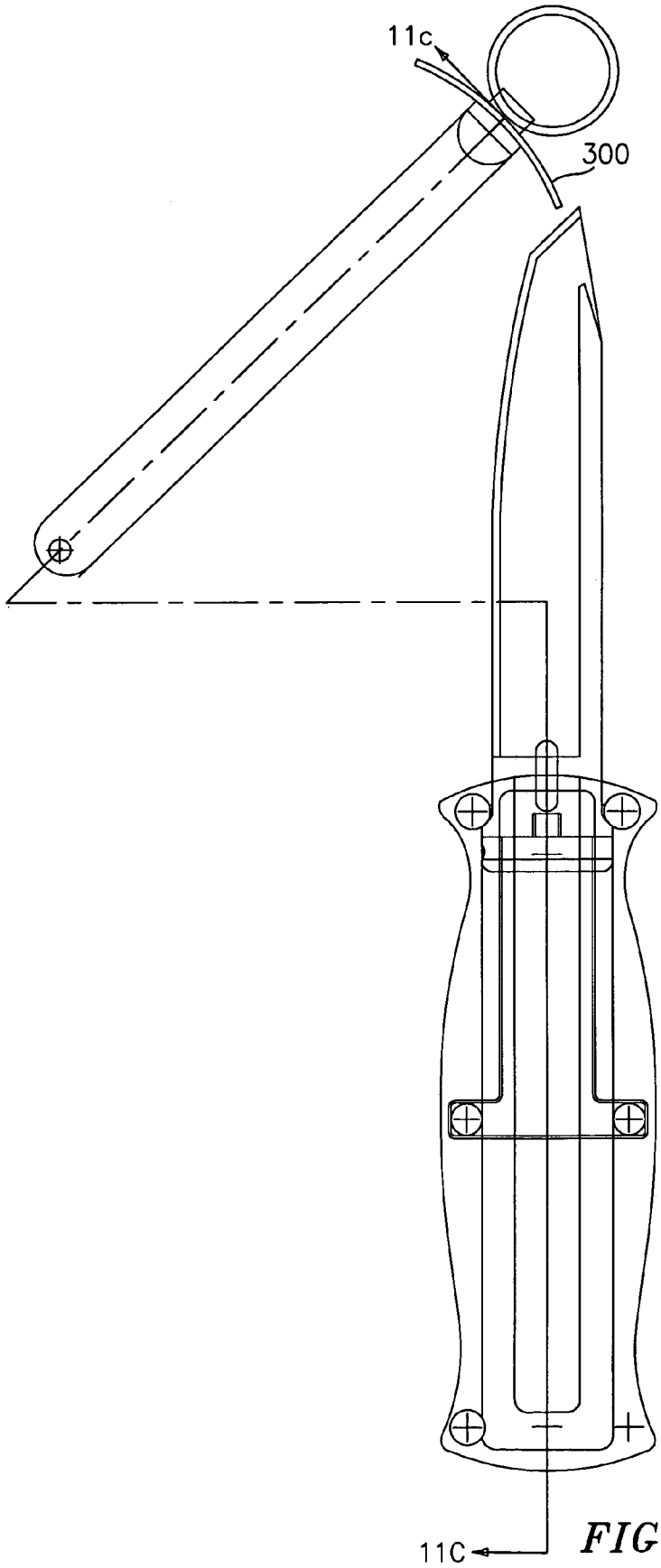
Figure 10D:
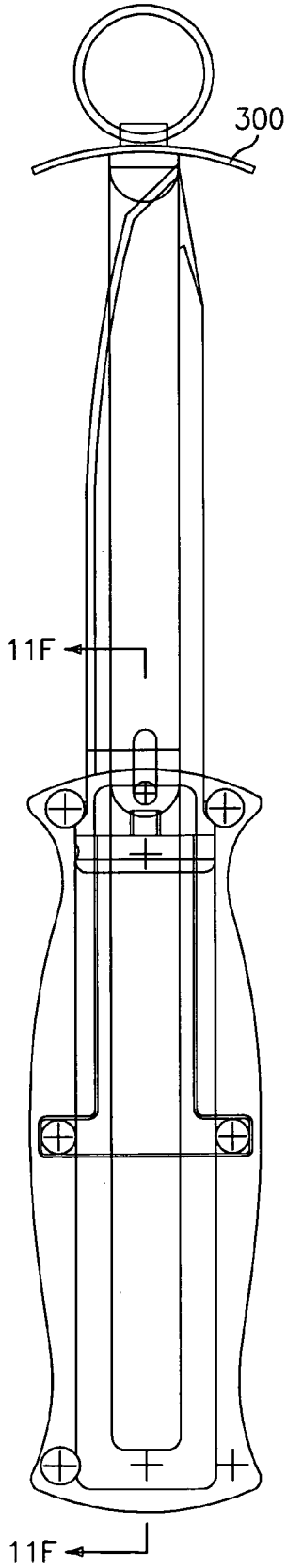
Figure 11A:
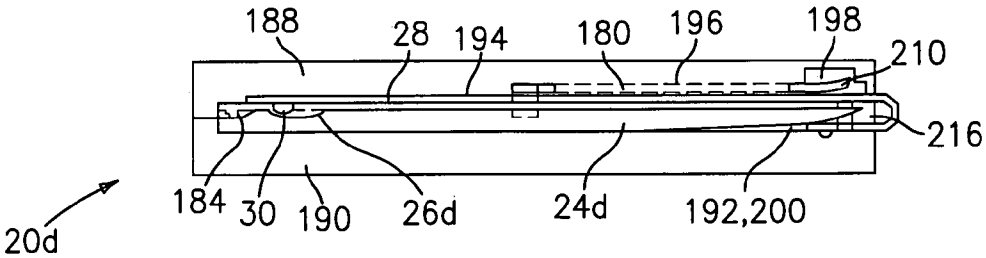
FIGS. 11A–11G are various cross-sectional views of the fourth embodiment of the sliding knife showing how the knife operates.

FIGS. 10A–10D and 11A–11G show how the fourth embodiment of the sliding knife 20*d* operates. In a retracted position, as shown in FIGS. 10A and 11A, the blade 24*d* lies within the confines of the handle 22*d*. The tongue 28 lies on top of the blade 24*d* within the secondary slot 194, holding the contoured spring 180 within the spring recess 196, with its detachment lip 210 extending into the spring clearance depression 198. Also, the ball 30 lies within the elongate blade detent 26*d*.

Figure 11B:
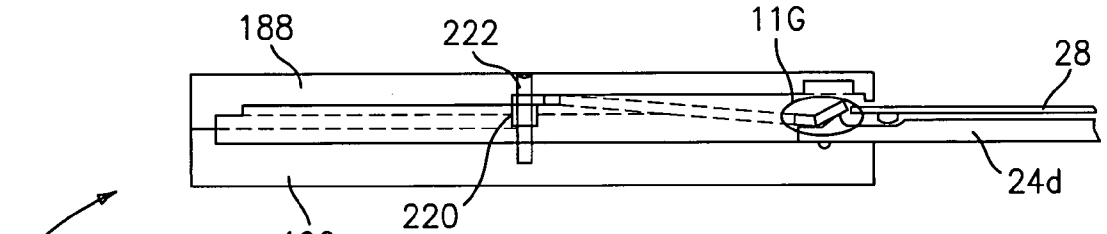
Figure 11G:
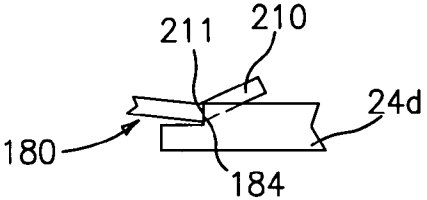
Figure 11C:
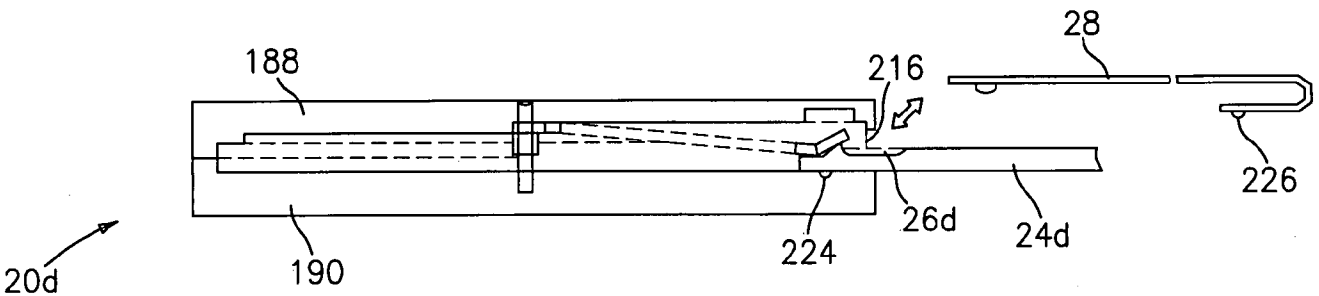

For deploying the blade 24*d*, the handle 22*d* is pulled away from the tongue 28. As the tongue 28 slides along the secondary slot 194, the blade 24*d* slides along the longitudinal slots 192, 200. When the blade 24*d* reaches its fully deployed position, as shown in FIGS. 10B, 11B, and 11G, the tongue clears the contoured spring 180, which springs into place against the blade 24*d*, locking it into place. More specifically, the spring shoulders 211 abut the rear-facing shoulder 184 of the blade 24*d*, with the upturned detachment lip 210 extending up through and past the slide 186. Subsequently, as shown in FIGS. 10C and 11C, the tongue 28 disengages from the remainder of the knife 20*d*.

Figure 11D:
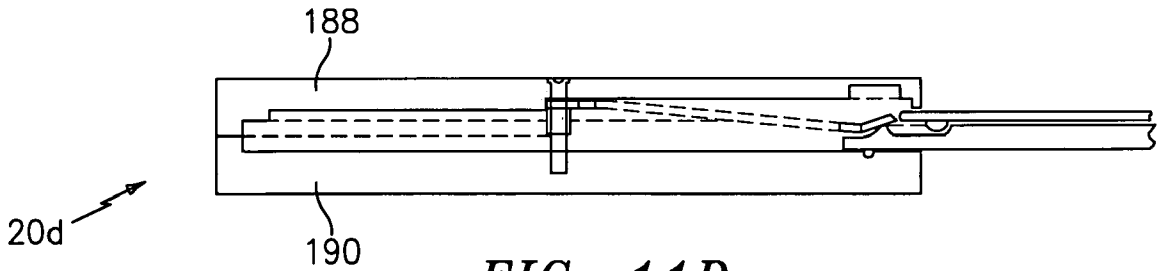
Figure 11E:
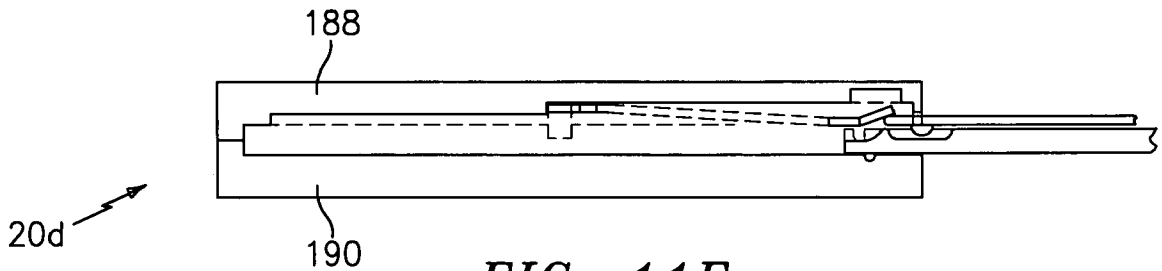
Figure 11F:
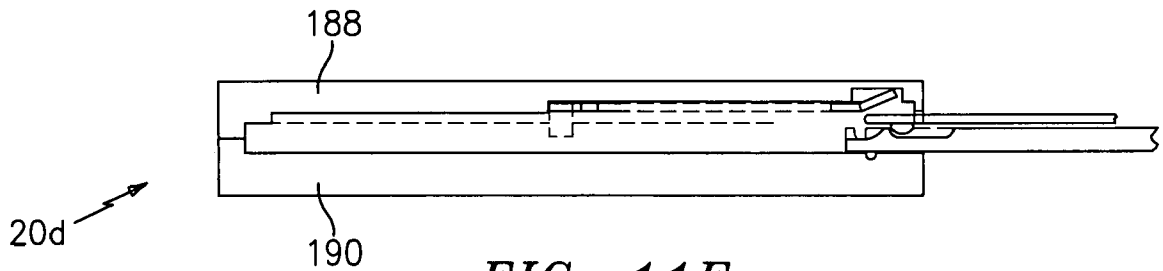

To retract the blade 24*d*, the tongue 28 is placed over the blade 24*d*, with the ball 30 in the elongate detent 26*d*, as shown in FIGS. 10B and 11D. Then, as indicated in FIG. 11E, the tongue 28 is pushed into the secondary slot 194, where the tongue 28 encounters the upturned detachment lip 210. Pushing the tongue further into the secondary slot forces the center portion 208 and lip 210 of the contoured spring 180 to flex upwards towards the spring recess 196. At the point where the ball 30 reaches the end of the elongate blade detent 26*d*, as shown in FIGS. 11F and 10D, the spring 180 disengages from the blade 24*d*. More specifically, as the spring 180 is forced into the spring recess 196, the shoulders 211 of the spring 180 clear the rear-facing shoulder 184 of the blade 24*d*. This allows the blade 24*d* to be pushed into the handle 22*d* along with the tongue 28. Once the blade is in its retraced position, the rear bumper 204 engages the blade side notch 214, holding it in place until the tongue 28 is pulled away from the handle 24*d*.

The contoured spring 180 may be attached to the handle 24*d* in any manner. For example, as shown in FIG. 11B, spacers 220 and bolts 222 through the handle 24*d* may be used.

For further frictionally securing the tongue 28 to the knife 24*d*, the handle 22*d* may be provided with a shallow detent 224, into which a small ball 226 (see FIG. 11C) on the tongue lip 46 fits.

Although the sliding knife 20*a*–20*d* of the present invention has been described as having certain blade locking mechanisms, one of ordinary skill in the art will appreciate that other locking mechanisms could be provided instead without departing from the spirit and scope of the invention. Also, as should be appreciated, although the knife 20*a*–20*d* has been shown as comprising certain parts, other similar parts could be used instead in many situations without departing from the spirit and scope of the invention.

Although the blade actuation mechanism (tongue) has been described herein as fitting over the blade and into a secondary slot, other configurations could also be used. For example, the blade itself could be provided with a longitudinal slot or groove extending partially down its length, into which the elongate portion of the tongue would fit. This would eliminate the need for a secondary slot for the tongue (of course, the locking mechanism would have to be appropriately repositioned/reconfigured).

Another example is shown in FIGS. 12A–12E and FIGS. 13A–13C, where an alternative embodiment of the sliding knife 250 comprises: a handle 252 with side slots 254*a*, 254*b* and a side locking mechanism (as further described below); a U-shaped tongue 256; and a blade 257.

Figure 12A:
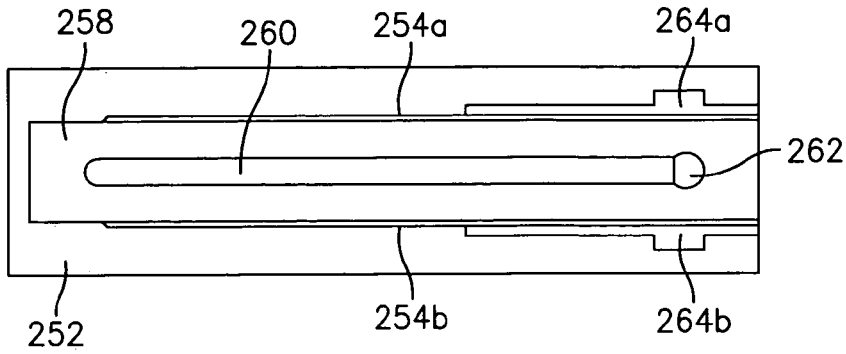
FIGS. 12A–12E show the components of an alternative embodiment of the sliding knife.
Figure 12B:
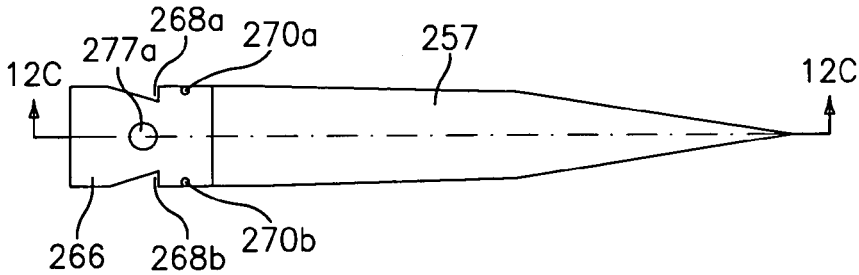
Figure 12C:
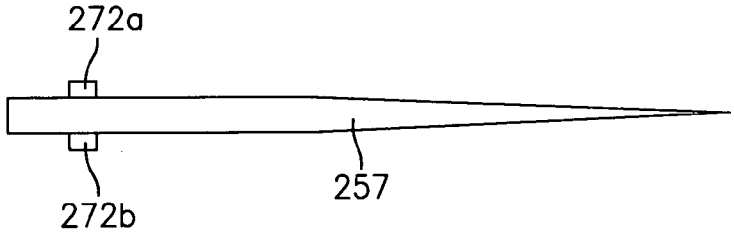
Figure 12D:
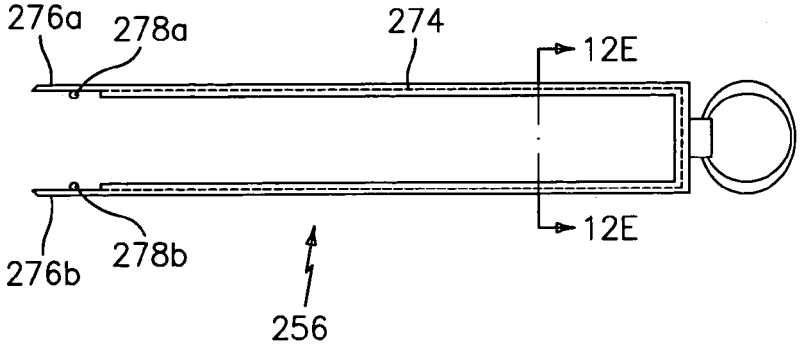
Figure 12E:
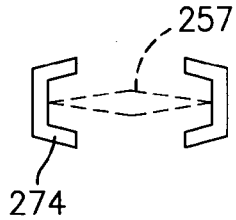

FIGS. 12A–12E show the components of the sliding knife 250. The handle 252 comprises: a main slot 258; guidance tracks 260 above and below the main slot (only one is shown in FIG. 12A); bumpers 262 at the ends of the guidance tracks; the side slots 254*a*, 254*b* extending off from the sides of the main slot 258 and dimensioned to accept the tongue 256; and spring recesses 264*a*, 264*b* extending outwards from the side slots. The blade 257 comprises a fore edged portion, a base 266 with rear-facing side notches 268*a*, 268*b* and side detents 270*a*, 270*b*, and top and bottom tabs 272*a*, 272*b* dimensioned to fit in the guide tracks 260. The U-shaped tongue 256 has a main "sheath" portion 274 dimensioned to accommodate the edged portion of the blade, and two wing extensions 276*a*, 276*b* connected thereto, each of which has an inwards facing ball 278*a*, 278*b*. When the tongue 256 is placed over the blade 257, the balls 278*a*, 278*b* engage the blade side detents 270*a*, 270*b*. Preferably, the wing extensions and/or the entire tongue are slightly flexible. Finally, as shown in FIGS. 13A–13C, contoured plate springs 280*a*, 280*b*, similar to those shown in FIGS. 9H and 9I, are attached to the handle 252 within the spring recesses 264*a*, 264*b*.

Figure 13A:
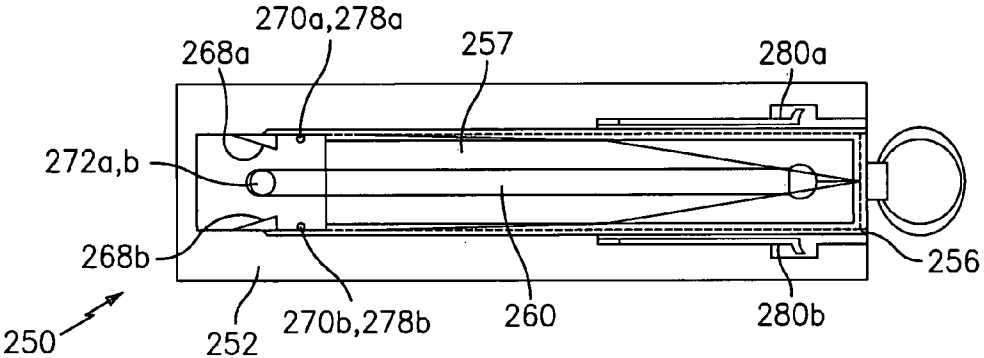
FIGS. 13A–13C show how the alternative embodiment of the sliding knife operates.
Figure 13B:
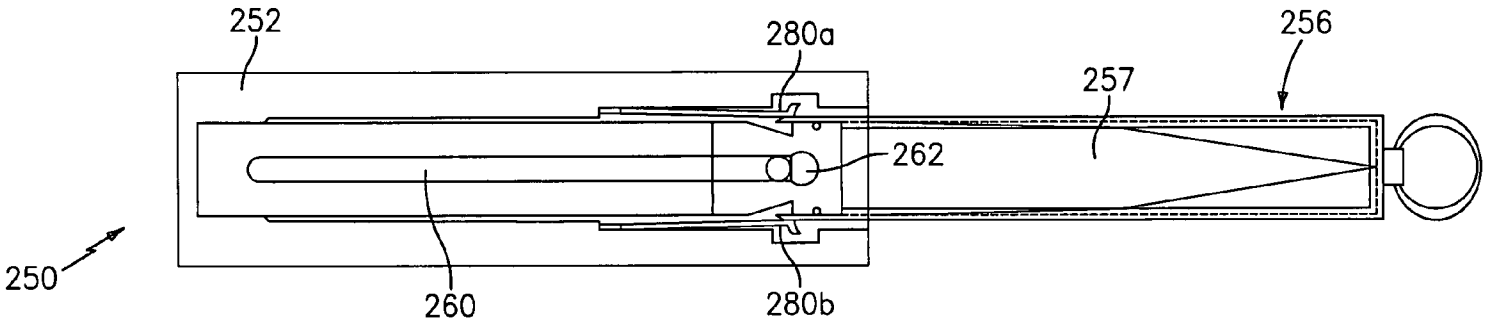
Figure 13C:
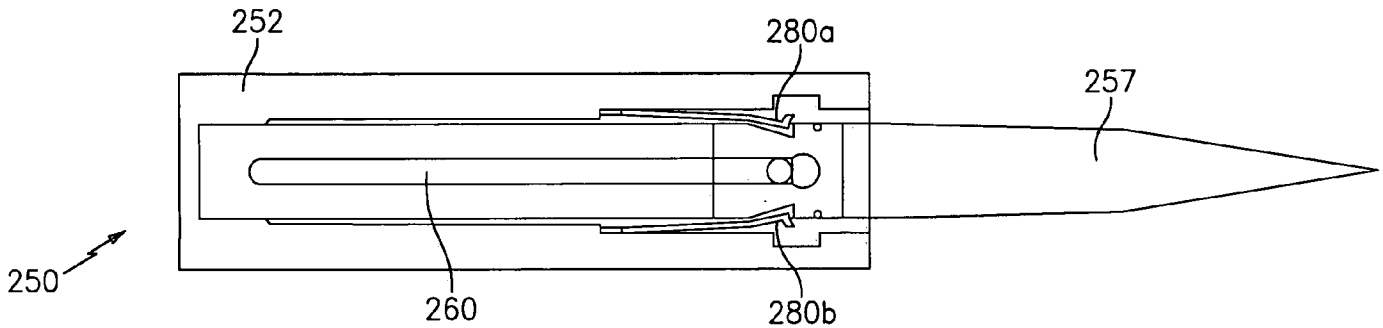
Figure 14A:
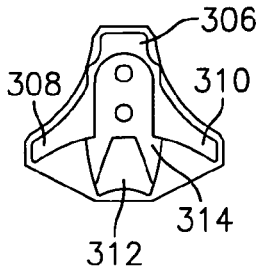
FIGS. 14A–14D show an alternative embodiment of the tongue.
Figure 14C:
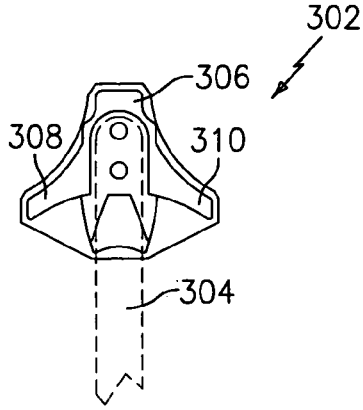
Figure 14B:
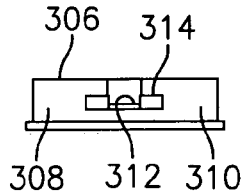
Figure 14D:
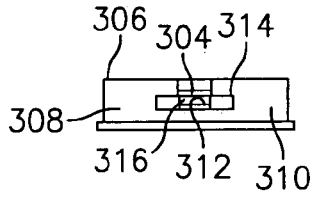

FIGS. 13A–13C show how the knife 250 operates. In a retracted position (FIG. 13A), the blade 257 lies within the confines of the handle 252, and is slideable along the slot 258. The tongue 256 lies within the side slots 254*a*, 254*b*, with the extensions 276*a*, 276*b* extending back along the base 266 of the blade 257, with the balls 278*a*, 278*b* engaging the blade side detents 270*a*, 270*b*, and the sheath portion 274 of the tongue covering the sharp edges of the blade. The tongue 256 pushes the springs 280*a*, 280*b* back into the spring recesses 264*a*, 264*b*.

When the tongue 256 is pulled away from the handle 252, the blade 257 tracks along. When the blade 257 reaches its fully deployed position, as shown in FIG. 13B, the tabs 272*a*, 272*b* hit the bumpers 262, which absorb any shock. Additionally, by virtue of the extension wings 276*a*, 276*b* (and/or the tongue 256) being slightly flexible, the balls 278*a*, 278*b* disengage from the blade side detents 270*a*, 270*b*, allowing the tongue 256 to disengage from the rest of the knife 250. The forward portions of the side slots 254*a*, 254*b* may be widened to allow the tongue to flex for disengagement.

Once the tongue 256 disengages, as shown in FIG. 13C, the contoured springs 280*a*, 280*b* are free to spring against the rear-facing blade side notches 268*a*, 268*b*, locking the blade into place. To retract the blade, the tongue 256 is placed over the blade, with the wing extensions 276*a*, 276*b* extending into the side slots 254*a*, 254*b* and pushing the springs 280*a*, 280*b* into the spring clearances 264*a*, 264*b*.

For further protecting a user's hands from the blade 24*a*–24*d*, the tongue 28 may be provided with extensions or wings 300, as shown in FIGS. 10A–10C. A more elaborate setup for securing the end of the blade 24*a*–24*d* is shown in FIGS. 14A–14D. Here, a cap-like tongue 302 comprises a thin, elongate member 304 (like the elongate extension 44 but without a U-shaped portion 46) and an end cap 306. The end cap 306 has: two wings 308, 310, which are dimensioned or contoured to fit up against the forward end of the handle 22*a*–22*d* (i.e., against the end of the handle where the blade comes out); a first, lower "pocket" landing 312; and an upper landing 314. The elongate member 304 is attached to the end cap 306 against the upper landing 314, thereby forming an open-ended pocket 316 between the elongate member 304 and the pocket landing 312. For retracting the blade 24*a*–24*d*, the tip of the blade is inserted into the pocket 316, preventing the blade from moving laterally. Then, the tongue 302 is used as described above to retract the blade.

Although the blade actuation mechanism (tongue) of the present invention has been illustrated as having a flat, elongate portion, one of ordinary skill in the art will appreciate that the tongue could be other shapes as well, e.g., round (shaft-like), hemispherical, bar-shaped, without departing from the spirit and scope of the invention.

As described above, the sliding knives 20*a*–20*d*, 250 are provided with one or more forward, left and right bumpers 50, 132, 202 attached to the knives' handles. The bumpers absorb the shock of the knife blade hitting against the handle when the knife blade reaches its fully extended position, and also apply a rearwards pressure to stabilize the blade and ensure a positive engagement with the locking mechanism. However, while the bumpers may optimize performance, they are not strictly necessary, since the sliding knife of the present invention would work without bumpers, or could be provided with alternative mechanisms for performing the same or a similar function. Additionally, in cases where it is desirable to have a slimmer knife profile, e.g., where the handle is not much wider than the blade and the blade does not have a flared base end, the bumpers may be repositioned in the handles, or may be affixed to the knife blade itself. An example of the former is shown in the knife 20*b* in FIGS. 5A–5K and 6A–6F. There, a single bumper 88 is attached to the middle of the handle 76, with the tab 104 attached to the base of the knife blade 24*b* (and dimensioned to fit within the guide track 86) hitting the bumper 88 when the knife blade is extended.

Figure 15A:
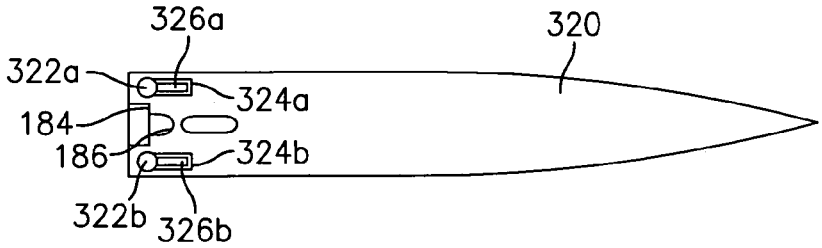
Figure 15B:
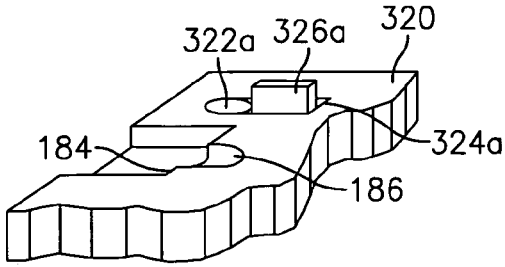
FIG. 15B shows a perspective view of a portion of the knife blade shown in FIG. 15A in detail.

An example of the latter is shown in FIGS. 15A and 15B. There, a knife blade 320 is generally similar to the knife blade 24*d* shown in FIGS. 9E–9G, except that it does not have a flared end dimensioned to hit the bumpers 202. Instead, the blade 320 has two bumpers 322*a*, 322*b* attached to the blade on either side of the shoulder 184 and center slide 186. Rectangular trenches 324*a*, 324*b* in the knife blade extend fore of each bumper 322*a*, 322*b*, respectively, into which are respectively positioned first and second "floating" bars 326*a*, 326*b* (i.e., small rectangular solids that are not attached to the blade 320). The portions of the bars 326*a*, 326*b* that extend above the tops of the trenches 324*a*, 324*b* slide in two parallel tracks (not shown, but similar to the track 86 in knife 20*b*) provided in the knife's handle. In use, when the blade 320 reaches its fully extended position, the fore edges of the bars 326*a*, 326*b* hit the fore inner edge of the handle (i.e., the ends of the two parallel tracks), causing the bars to move rearwards against the bumpers 322*a*, 322*b*, absorbing any shock. At this point, the locking mechanism engages, with the bars 326*a*, 326*b* effectively pressing against the bumpers and thereby exerting a rearwards force to stabilize the blade and facilitate its engagement with the locking mechanism. Other, similar arrangements are also possible.

Although the sliding knife with disengaging blade actuation mechanism of the present invention has been illustrated as having a conventional or tanto-like blade, one of ordinary skill in the art will appreciate that any style of knife blade could be provided, (e.g., serrated blades, blades with hook-shaped portions, razor blades, non-edged blades), without departing from the spirit and scope of the invention. Furthermore, the present invention could be adapted for use with larger bladed weapons (e.g., daggers, swords), or for use with non-bladed weapons or tools (e.g., stilettos, rapiers).

While the sliding knife of the present invention has been illustrated as having a retractable blade (wherein the tongue is used to retract the blade and, in some embodiments, unlock the locking mechanism), one of ordinary skill in the art will appreciate that the knife r could be provided in single-use form without departing from the spirit and scope of the invention. More specifically, the knife could be configured so that once the blade is extended for use and locked into place, it cannot be retracted without taking the knife apart and/or using a special tool. Such a feature might be useful for certain emergency situations, or when the tongue is permanently or semi-permanently affixed to a fixture, e.g., to a parachute harness or the wall inside an airplane cockpit.

Although the sliding knife of the present invention has been illustrated as having a blade with a detent located proximate the blade's base, one of ordinary skill in the art will appreciate that the detent (or a similar feature for engaging the blade actuation mechanism) could be located elsewhere on the blade, without departing from the spirit and scope of the invention.

Since certain changes may be made in the above sliding knife with disengaging blade actuation mechanism, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Having thus described the invention, what is claimed is:

1. A knife comprising:

a. a handle having a main slot and a secondary slot, said main slot and said secondary slot defining a fore opening in the handle;

b. a blade slidable along the main slot between a retracted position, wherein the blade lies within the handle, and an extended position wherein the blade lies partially extended through and past the fore opening;

c. a locking mechanism cooperative with the handle and blade to hold the blade in the blade's extended position; and d. a blade actuation mechanism slidable along the secondary slot and removable from the secondary slot and handle; wherein the blade actuation mechanism is configured to detachably engage the blade when in the secondary slot, with the blade actuation mechanism moving the blade when the blade actuation mechanism is slid along the secondary slot and detaching from the blade and leaving the secondary slot and handle when the blade reaches the blade's extended position.

2. The knife of claim 1 further comprising at least one bumper attached to the handle or the blade for absorbing shock created by the blade being slid into the blade's extended position and for exerting a rearwards force against the blade to stabilize the blade and enhance the operation of the locking mechanism.

3. The knife of claim 1 wherein: the blade has a detent located proximate a base end of the blade; and the blade actuation mechanism has a ball, dimensioned to fit into the detent, for moving the blade when the blade actuation mechanism is slid along the secondary slot.

4. The knife of claim 1 further comprising a friction lock for holding the blade in the blade's retracted position and the blade actuation mechanism within the secondary slot, wherein the friction lock is configured to release the blade and blade actuation mechanism when a manual force is applied to the blade actuation mechanism.

5. The knife of claim 1 wherein the blade actuation mechanism is a generally flat, elongate member.

6. The knife of claim 1 wherein:

a. the blade actuation mechanism, if removed from the secondary slot and handle, can be reinserted into the secondary slot and handle; and b. the blade actuation mechanism is configured to unlock the locking mechanism and move the blade from the blade's extended position to the blade's retracted position when the blade actuation mechanism is reinserted into the secondary slot and handle.

7. The knife of claim 6 wherein:

a. a base end of the blade has a center slide and a rear-facing blade shoulder; and b. the locking mechanism comprises a plate spring, said plate spring comprising:

i. a stanchion end attached to the handle;

ii. a center portion attached to the stanchion end; and iii. an upturned detachment lip attached to the center portion and defining a spring shoulder with the center portion; wherein:

c. when the blade is slid to the blade's extended position, the spring is configured to spring into place with the spring shoulder abutting the blade shoulder to hold the blade in place, and with the detachment lip extending up through the center slide; and d. when the blade actuation mechanism is reinserted into the secondary slot and handle, the blade actuation mechanism is configured to press against the detachment lip to move the spring shoulder away from the blade shoulder, thereby unlocking the blade.

8. A knife comprising:

a. a handle;

b. a blade slidable within the handle between a retracted position and an extended position; and c. a removable blade actuation mechanism which fits over the blade and within the handle, wherein the blade actuation mechanism is configured to slide within the handle to engage and slide the blade when within the handle and to disengage from the blade and handle when the blade reaches its extended position.

9. The knife of claim 8 further comprising a locking mechanism cooperative with the blade and handle and configured to hold the blade in the blade's extended position.

10. The knife of claim 9, wherein the blade actuation mechanism is configured to unlock the locking mechanism holding the blade in the blade's extended position, and to engage and slide the blade to the blade's retracted position.

11. The knife of claim 9 further comprising at least one bumper attached to the handle or the blade for absorbing shock created by the blade being slid into the blade's extended position and for exerting a rearwards force against the blade to stabilize the blade and enhance the operation of the locking mechanism.

12. The knife of claim 8 further comprising at least one bumper attached to the handle or the blade for absorbing shock created by the blade being slid into the blade's extended position.

13. The knife of claim 8 wherein:

a. the blade actuation mechanism comprises: an elongate portion that fits within the handle and engages the blade; and an end portion attached to the elongate portion and accessible from outside the handle; and b. the knife is actuated by a user pulling the end portion of the blade actuation mechanism away from the handle, thereby causing the elongate portion to slide the blade to the blade's extended position and the blade actuation mechanism to disengage from the blade and the handle.

14. The knife of claim 8 further comprising a friction lock for holding the blade in the blade's retracted position and the blade actuation mechanism within the handle, wherein the friction lock is configured to release the blade and blade actuation mechanism when a manual force is applied to the blade actuation mechanism.

15. The knife of claim 8 wherein the blade actuation mechanism comprises a generally flat, elongate member.

16. A knife comprising:

a. a handle;

b. a blade slidable within the handle between a retracted position and an extended position;

c. a locking mechanism cooperative with the handle and blade for holding the blade in the blade's extended position; and d. a removable blade actuation mechanism which fits and slides within the handle, wherein: the blade actuation mechanism is configured to slide the blade to the blade's extended position when the blade actuation mechanism is pulled away and removed from the handle; and the blade actuation mechanism is configured to unlock the locking mechanism and slide the blade to the blade's retracted position when the blade actuation mechanism is reinserted into the handle.

17. The knife of claim 16 further comprising at least one bumper attached to the handle or the blade for absorbing shock created by the blade being slid into the blade's extended position and for exerting a rearwards force against the blade to stabilize the blade and enhance the operation of the locking mechanism.

18. The knife of claim 16 wherein: the blade has a detent located proximate a base end of the blade; and the blade actuation mechanism has a ball, dimensioned to fit into the detent, for sliding the blade along with the blade actuation mechanism.

19. The knife of claim 16 further comprising a friction lock for holding the blade in the blade's retracted position and the blade actuation mechanism within the handle, wherein the friction lock is configured to release the blade and blade actuation mechanism when a manual force is applied to the blade actuation mechanism.

20. A knife comprising:

a. a handle;

b. a blade slidable within the handle between a retracted position and an extended position; and c. a blade actuation mechanism that fits and slides within the handle, said blade actuation mechanism having an end portion accessible from outside the handle, and said blade actuation mechanism being moveable between a first position, coincident with the blade's retracted position, where the blade actuation mechanism engages the blade, and a second position, coincident with the blade's extended position, where the blade actuation mechanism can be disengaged from the blade and removed from the handle; wherein to actuate the blade for use when the blade is in its retracted position: the end portion of the blade actuation mechanism accessible from outside the handle is pulled away from the handle until the blade actuation mechanism is moved to its second position, thereby sliding the blade from its retracted position to its extended position; and the blade actuation mechanism is disengaged from the blade and removed from the handle.

21. The knife of claim 20 further comprising a locking mechanism cooperative with the blade and handle to hold the blade in the blade's extended position.

22. The knife of claim 21 wherein the locking mechanism is configured to be unlocked by the blade actuation mechanism when the blade actuation mechanism is moved from its second position towards its first position.

23. A knife comprising:

a. a handle;

b. a blade movable within the handle between an extended position and a retracted position in which the blade is fully contained within the handle; and c. a removable blade actuation mechanism, wherein a portion of the blade actuation mechanism fits within the handle, wherein the blade actuation mechanism is configured to extend and to retract the blade; and wherein to actuate the knife for use, the blade actuation mechanism is used to extend the blade, and the blade actuation mechanism is removed from the handle.

24. The knife of claim 23 further comprising a locking mechanism attached to the blade or handle and configured to hold the blade in the blade's extended position.

25. The knife of claim 24 wherein:

a. when the knife has been actuated for use and the blade actuation mechanism has been removed from the handle, the blade actuation mechanism can be reinserted into the handle to retract the blade; and b. the locking mechanism is configured to be unlocked by the blade actuation mechanism when the blade actuation mechanism is reinserted into the handle to retract the blade.

26. A knife comprising:

a. a handle slidably housing an extendable blade and configured to fully receive the blade therein;

b. a blade actuation mechanism, wherein a portion of the blade actuation mechanism fits within the handle; said blade actuation mechanism operably coupled to the blade and handle and configured to extend the blade and disengage from the blade and handle when the blade is extended; and c. a locking mechanism cooperative with the blade and handle for keeping the blade extended.

27. A knife comprising:

a. a handle;

b. a blade movable within the handle between an extended position and a retracted position in which the blade is fully contained within the handle; and c. blade actuation means for extending and retracting the blade, a portion of said blade actuation means fitting within the handle and being removable from the handle, wherein to actuate the knife for use, the blade actuation means is used to extend the blade and the blade actuation means is removed from the handle, and wherein to move the blade to the blade's retracted position, the blade actuation means is reinserted into the handle.

28. The knife of claim 27 further comprising locking means cooperative with the blade and handle for holding the blade in the blade's extended position, wherein the locking means can be unlocked to allow the blade to be moved to the blade's retracted position.

29. The knife of claim 28 wherein the blade actuation means is configured to unlock the locking mechanism and move the blade to the blade's retracted position when reinserted into the handle.

30. A knife comprising:

a. a handle;

b. a blade movable within the handle between an extended position and a retracted position;

c. blade actuation means for extending and retracting the blade, a portion of said blade actuation means fitting within the handle and being removable from the handle, wherein to actuate the knife for use, the blade actuation means is used to extend the blade and the blade actuation means is removed from the handle, and wherein to move the blade to the blade's retracted position, the blade actuation means is reinserted into the handle; and d. shock absorbing means attached to the handle for absorbing shock when the blade is moved to the blade's extended position.

31. A knife comprising:

a. a handle;

b. a blade movable within the handle between a retracted position and an extended position;

c. blade actuation means for moving the blade, a portion of said blade actuation means fitting within the handle and being removable from the handle when the blade is moved to the blade's extended position, the handle being configured to dangle by the blade actuation means while the blade is in the retracted position; and d. locking means cooperative with the blade and handle for holding the blade in the blade's extended position.

32. The knife of claim 31 wherein the blade actuation means is configured to be reinserted into the handle for moving the blade to the blade's retracted position.

33. The knife of claim 32 wherein: the locking means can be unlocked so as to no longer hold the blade in the blade's extended position; and the blade actuation means is configured to unlock the locking means when the blade actuation means is reinserted into the handle to move the blade into the blade's retracted position.

34. The knife of claim 31 wherein the handle is configured to fully receive the blade therein while the blade is in the retracted position.

* * * * *